US009823595B2

(12) United States Patent
Toyoizumi et al.

(10) Patent No.: US 9,823,595 B2
(45) Date of Patent: Nov. 21, 2017

(54) TONER

(71) Applicant: CANON KABUSHIKI KAISHA, Tokyo (JP)

(72) Inventors: Noritaka Toyoizumi, Mishima (JP); Yusuke Kosaki, Susono (JP); Tetsuya Kinumatsu, Mishima (JP); Kenji Aoki, Mishima (JP); Shuntaro Watanabe, Hadano (JP); Takaaki Kaya, Suntou-gun (JP); Atsushi Tani, Suntou-gun (JP); Takashige Kasuya, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/176,520

(22) Filed: Jun. 8, 2016

(65) Prior Publication Data

US 2017/0003612 A1 Jan. 5, 2017

(30) Foreign Application Priority Data

Jun. 30, 2015 (JP) ..... 2015-131015

(51) Int. Cl.
*G03G 9/093* (2006.01)

(52) U.S. Cl.
CPC ..... *G03G 9/09321* (2013.01); *G03G 9/09328* (2013.01); *G03G 9/09342* (2013.01); *G03G 9/09378* (2013.01)

(58) Field of Classification Search
CPC ..... G03G 9/09321; G03G 9/09371; G03G 9/09328
USPC ..... 430/110.2
See application file for complete search history.

(56) References Cited

U.S. PATENT DOCUMENTS

| | | | |
|---|---|---|---|
| 5,298,354 | A | 3/1994 | Matsunaga et al. |
| 5,300,386 | A | 4/1994 | Kanbayashi et al. |
| 5,407,776 | A | 4/1995 | Kanbayashi et al. |
| 5,478,686 | A | 12/1995 | Kawakami et al. |
| 5,500,321 | A | 3/1996 | Kasuya et al. |
| 5,529,873 | A | 6/1996 | Chiba et al. |
| 5,558,967 | A | 9/1996 | Nagatsuka et al. |
| 5,571,653 | A | 11/1996 | Kasuya et al. |
| 5,578,407 | A | 11/1996 | Kasuya et al. |
| 5,691,093 | A | 11/1997 | Kanbayashi et al. |
| 5,700,616 | A | 12/1997 | Kasuya et al. |
| 5,712,073 | A | 1/1998 | Katada et al. |
| 5,840,457 | A | 11/1998 | Urawa et al. |
| 5,972,553 | A | 10/1999 | Katada et al. |
| 6,002,895 | A | 12/1999 | Kasuya et al. |
| 6,214,509 | B1 | 4/2001 | Kasuya et al. |
| 6,300,024 | B1 | 10/2001 | Yusa et al. |
| 6,485,875 | B1 | 11/2002 | Karaki et al. |
| 6,586,151 | B1 | 7/2003 | Naka et al. |
| 6,664,016 | B2 | 12/2003 | Kanbayashi et al. |
| 6,751,424 | B2 | 6/2004 | Komatsu et al. |
| 6,875,549 | B2 | 4/2005 | Yamazaki et al. |
| 6,881,527 | B2 | 4/2005 | Moribe et al. |
| 7,014,969 | B2 | 3/2006 | Yachi et al. |
| 7,147,980 | B2 | 12/2006 | Itakura et al. |
| 7,150,953 | B2 | 12/2006 | Yamazaki et al. |
| 7,229,727 | B2 | 6/2007 | Itakura et al. |
| 7,238,387 | B2 | 7/2007 | Ogawa et al. |
| 7,244,539 | B2 | 7/2007 | Baba et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,422,832 | B2 | 9/2008 | Ogawa et al. |
| 7,452,649 | B2 | 11/2008 | Magome et al. |
| 7,537,877 | B2 | 5/2009 | Yoshiba et al. |
| 7,582,401 | B2 | 9/2009 | Ogawa et al. |
| 7,678,524 | B2 | 3/2010 | Hasegawa et al. |
| 7,700,254 | B2 | 4/2010 | Moribe et al. |
| 7,704,659 | B2 | 4/2010 | Ogawa et al. |
| 7,776,501 | B2 | 8/2010 | Tamura et al. |
| 7,794,908 | B2 | 9/2010 | Kaya et al. |
| 7,794,909 | B2 | 9/2010 | Kaya et al. |
| 7,811,734 | B2 | 10/2010 | Ogawa et al. |

(Continued)

FOREIGN PATENT DOCUMENTS

| | | | |
|---|---|---|---|
| JP | 2006-091283 | A | 4/2006 |
| JP | 2010-132851 | A | 6/2010 |

(Continued)

OTHER PUBLICATIONS

U.S. Appl. No. 15/071,987, Kenji Aoki, filed Mar. 16, 2016.
U.S. Appl. No. 15/073,572, Tetsuya Kinumatsu, filed Mar. 17, 2016.
U.S. Appl. No. 15/178,333, Kosaki Yusuke, filed Jun. 9, 2016.

*Primary Examiner* — Janis L Dote

(74) *Attorney, Agent, or Firm* — Fitzpatrick Cella Harper and Scinto

(57) ABSTRACT

Provided is a toner including toner particle, the toner particle having a core-shell structure having: a core containing a core resin, a colorant, and a wax; and a shell layer containing a resin "A" on a surface of the core, in which: the resin "A" contains a segment having an organopolysiloxane structure; the toner particle has an amount of Si derived from the organopolysiloxane structure of 6.0 or more and 10.0 or less, the amount of Si being measured by X-ray photoelectron spectroscopy; the resin "A" is a polymer of a monomer composition containing a monomer "a" having two or more polymerizable unsaturated groups in one molecule thereof; and the monomer "a" satisfies the following formula (1).

$$(Xa-1.0)\times Ya\geq 3.0\times 10^{-5} \quad (1)$$

8 Claims, 2 Drawing Sheets

(56) References Cited

U.S. PATENT DOCUMENTS

| | | | |
|---|---|---|---|
| 7,935,771 | B2 | 5/2011 | Fukui et al. |
| 7,939,231 | B2 | 5/2011 | Ogawa et al. |
| 7,943,281 | B2 | 5/2011 | Kaya et al. |
| 8,084,174 | B2 | 12/2011 | Hasegawa et al. |
| 8,093,342 | B2 | 1/2012 | Minami et al. |
| 8,110,329 | B2 | 2/2012 | Tominaga et al. |
| 8,178,275 | B2 | 5/2012 | Tani et al. |
| 8,372,573 | B2 | 2/2013 | Ayaki et al. |
| 8,383,312 | B2 | 2/2013 | Fujimoto et al. |
| 8,460,845 | B2 | 6/2013 | Kaya et al. |
| 8,465,896 | B2 | 6/2013 | Sekikawa et al. |
| 8,475,987 | B2 | 7/2013 | Kaya et al. |
| 8,497,056 | B2 | 7/2013 | Sekikawa et al. |
| 8,551,680 | B2 | 10/2013 | Ayaki et al. |
| 8,603,712 | B2 | 12/2013 | Aoki et al. |
| 8,652,725 | B2 | 2/2014 | Watanabe et al. |
| 8,741,519 | B2 | 6/2014 | Watanabe et al. |
| 8,785,101 | B2 | 7/2014 | Kaya et al. |
| 8,846,284 | B2 | 9/2014 | Kinumatsu et al. |
| 8,975,000 | B2 | 3/2015 | Tani et al. |
| 9,056,956 | B2 | 6/2015 | Kojima et al. |
| 9,057,971 | B2 | 6/2015 | Watanabe et al. |
| 9,176,410 | B2 | 11/2015 | Tani et al. |
| 9,309,349 | B2 | 4/2016 | Watanabe et al. |
| 2002/0055053 | A1 | 5/2002 | Kasuya et al. |
| 2004/0110076 | A1 | 6/2004 | Yamazaki et al. |
| 2010/0035171 | A1 | 2/2010 | Watanabe et al. |
| 2010/0273102 | A1 | 10/2010 | Tamura et al. |
| 2013/0130169 | A1 | 5/2013 | Aoki et al. |
| 2014/0349232 | A1 | 11/2014 | Kinumatsu et al. |
| 2014/0356777 | A1* | 12/2014 | Tani ..... G03G 9/09321 430/108.3 |
| 2015/0355563 | A1 | 12/2015 | Aoki et al. |
| 2016/0187797 | A1 | 6/2016 | Kosaki et al. |
| 2016/0187798 | A1 | 6/2016 | Toyoizumi et al. |

FOREIGN PATENT DOCUMENTS

| | | | |
|---|---|---|---|
| JP | 2010-168522 | A | 8/2010 |
| JP | 2012-042939 | A | 3/2012 |
| JP | 2013-137495 | A | 7/2013 |
| WO | 2013-179490 | A | 12/2013 |

* cited by examiner

TONER

BACKGROUND OF THE INVENTION

Field of the Invention

The present invention relates to a toner to be used in an electrophotographic method, an electrostatic recording method, and a toner jet type recording method.

Description of the Related Art

As a toner for an improvement in low-temperature fixability and storage stability of the toner, there is a toner particle having a core-shell structure in which the surface of a resin serving as a core is covered with a shell resin.

Furthermore, a method involving using a hydrophobic material that is hardly affected by a temperature and a humidity as the shell resin covering the surface of the toner particle is conceivable as a method of improving the environmental stability of the toner. An organopolysiloxane has been known as a material having low interfacial tension.

Therefore, the introduction of an organopolysiloxane structure into the shell resin of the toner particle is expected to be capable of imparting charging performance that is not affected by a humidity.

However, the glass transition point (Tg) of the organopolysiloxane is generally lower than room temperature. Accordingly, when the organopolysiloxane is present in a large amount in the shell resin, the surface of the toner particle softens and hence the durability of the toner reduces. Accordingly, it is important to control the introduction amount and state of presence of the organopolysiloxane.

In Japanese Patent Application Laid-Open No. 2006-91283, there is a proposal of a toner particle having a core-shell structure, the toner particle containing an organopolysiloxane compound in each of a core resin and a shell resin. The evaluation of a toner produced based on the disclosure has confirmed that the toner has a suppressing effect on fluctuations in charging performance due to a high-temperature and high-humidity environment, and a low-temperature and low-humidity environment.

In Japanese Patent Application Laid-Open No. 2010-132851, there is a proposal of a method of producing such a toner particle that a resin fine particle is fixed to, or is formed into a film on, its surface. In the method, carbon dioxide in a liquid state or a supercritical state is used as a dispersion medium, and a toner particle is formed in the dispersion medium having dispersed therein the resin fine particle and a compound having a dimethylpolysiloxane group serving as a dispersion stabilizer. Thus, a toner particle having the resin fine particle fixed to its surface is obtained.

In Japanese Patent Application Laid-Open No. 2010-168522, there is a proposal of a method of producing a toner particle having a resin fine particle adhering to its surface. In the method, carbon dioxide in a liquid or supercritical state is used as a dispersion medium, and a toner particle is formed in the dispersion medium having dispersed therein a resin fine particle formed of a silicone resin. Thus, a toner in which the resin fine particle adheres to the surface of the toner particle is obtained.

In Japanese Patent Application Laid-Open No. 2013-137495, there is a proposal of a toner particle having a core-shell structure in which a shell layer based on a resin containing the organopolysiloxane structure is formed.

The toner particle is produced by using a resin fine particle containing the resin containing the organopolysiloxane structure and by using the same method as that of Japanese Patent Application Laid-Open No. 2010-168522, and the optimization of the amount of a segment having the organopolysiloxane structure present in the surface of the toner particle can achieve both environmental stability and durability.

SUMMARY OF THE INVENTION

However, the inventors of the present invention have investigated the toner of Japanese Patent Application Laid-Open No. 2006-91283, and as a result, have found that the toner involves a problem in terms of low-temperature fixability. It has been assumed that the following fact is a cause for the foregoing. The organopolysiloxane compound is incorporated into the core resin. Accordingly, the exudation of a wax at the time of fixation is inhibited and hence a cold offset is liable to occur. Further, it has been assumed that the following fact is also a cause for the foregoing. The amount of the shell resin to be used is as large as from about 20 parts by mass to about 60 parts by mass with respect to 100 parts by mass of the core resin, and hence a shell layer is thick. Accordingly, it is not easy for the core resin to receive sufficient heat from a heat roller at the time of the fixation.

In addition, when the toner of Japanese Patent Application Laid-Open No. 2010-132851 was evaluated for its chargeability, the chargeability was susceptible to a humidity and hence expected environmental stability could not be obtained. It has been assumed that this is because the compound having an organopolysiloxane structure was removed in a process for toner production.

In addition, it has been found that when the toner of Japanese Patent Application Laid-Open No. 2010-168522 was evaluated, satisfactory environmental stability was obtained in its charging performance but expected durability was not obtained. It has been assumed that this is because of the following reason. The amount of a segment having an organopolysiloxane structure in the silicone resin is as large as about 40 parts by mass with respect to 100 parts by mass of the silicone resin, and hence the silicone resin is soft. Accordingly, the surface of the toner particle is liable to soften and hence the durability is not obtained.

Further, it has been found that when the toner of Japanese Patent Application Laid-Open No. 2013-137495 was subjected to a durability test after the toner had been left to stand under a severe environment for a long time period, an image failure occurred in some cases and hence the effect of environmental stability was not necessarily sufficient.

As described above, it has still been difficult to achieve all of environmental stability, durability, and low-temperature fixability in a toner including a toner particle containing a compound having an organopolysiloxane structure.

The present invention has been made in view of such problems as described above, and an object of the present invention is to provide a toner that is excellent in charging stability, environmental stability, and durability, and is excellent in low-temperature fixability and storage stability.

The present invention relates to a toner including a toner particle having a core-shell structure having:

a core containing a core resin, a colorant, and a wax; and a shell layer containing a resin "A" on a surface of the core, in which:

the resin "A" contains a segment having an organopolysiloxane structure;

the toner particle has an amount of Si (atomic %) derived from the organopolysiloxane structure of 6.0 or more and 10.0 or less, the amount of Si being measured by X-ray photoelectron spectroscopy (ESCA);

the resin "A" is a polymer of a monomer composition containing a monomer "a" having two or more polymerizable unsaturated groups in one molecule thereof; and the monomer "a" satisfies the following formula (1):

$$(Xa-1.0)\times Ya \geq 3.0\times 10^{-5} \quad (1)$$

in the formula (1),

Xa represents an average number of polymerizable unsaturated groups in one molecule of the monomer "a", and Ya represents a number of moles (mol/g) of the monomer "a" with respect to a total mass of all monomers in the monomer composition.

Further features of the present invention will become apparent from the following description of exemplary embodiments with reference to the attached drawings.

DESCRIPTION OF THE EMBODIMENTS

Figure 1:
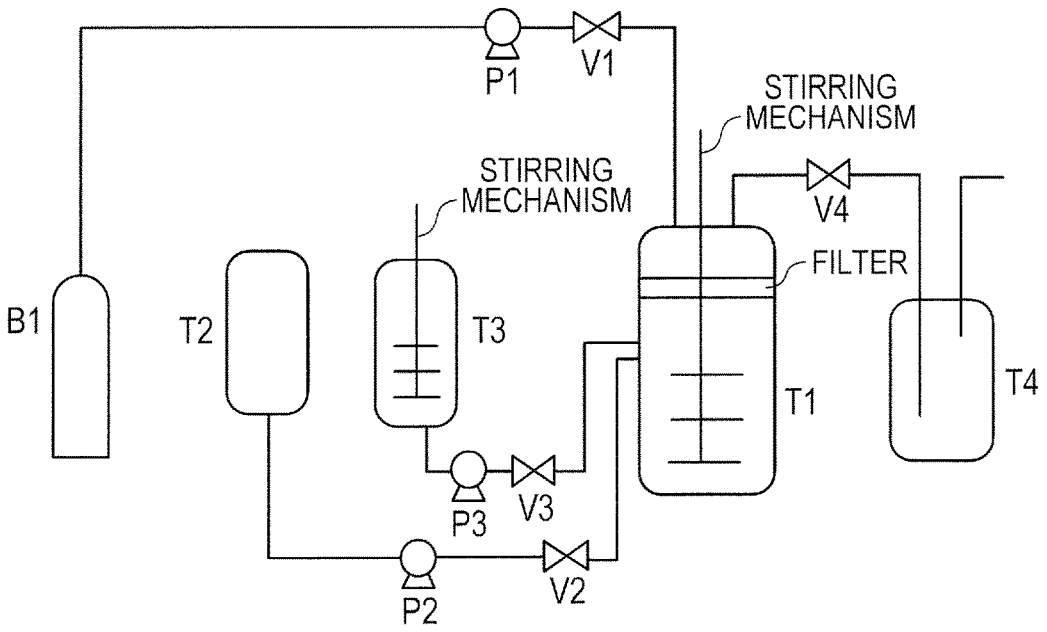
FIG. 1 is a view for illustrating an example of each of a production method and a production apparatus for a toner particle of the present invention.

Preferred embodiments of the present invention will now be described in detail in accordance with the accompanying drawings.

A toner of the present invention is a toner including a toner particle having a core-shell type (structure) having: a core containing a core resin, a colorant, and a wax; and a shell layer containing a resin "A" on the surface of the core.

Further, the resin "A" contains a segment having an organopolysiloxane structure. The organopolysiloxane structure has a repeating unit of a Si—O bond represented by the following formula (I), and has a structure in which two alkyl groups are bonded to each Si element.

Formula (I)

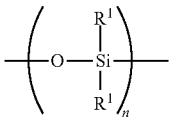

In the formula (I), $R^1$ represents an alkyl group. In addition, n represents a polymerization degree and represents an integer of 2 or more. As described above, a compound having the organopolysiloxane structure has low interfacial tension.

Therefore, the presence of the resin containing the segment having the organopolysiloxane structure in the surface of the toner particle can suppress a change in environmental stability of the toner, especially a change in charge quantity thereof under each of a high-temperature and high-humidity environment, and a low-temperature and low-humidity environment.

Meanwhile, the glass transition temperature (Tg) of the compound having the organopolysiloxane structure is lower than room temperature, and hence the compound is a viscous liquid at room temperature. Therefore, when the amount of the segment having the organopolysiloxane structure in the resin "A" increases, the surface of the toner particle soften and hence the durability of the toner is liable to reduce.

Therefore, the suppression of the softening through the optimization of the content of the segment having the organopolysiloxane structure in the resin "A" covering the surface of the toner particle is important for achieving both the environmental stability and the durability.

However, it has been found that even in the case where the content of the segment having the organopolysiloxane structure is optimized, a sufficient effect is not obtained when the toner is exposed to a severer temperature and humidity environment for a long time period. As a result of an investigation on a cause for the foregoing, it has been found that the wax in the toner particle or a low-molecular weight component in the core resin exudes to the surface of the toner particle to reduce the durability. An increase in amount of the segment having the organopolysiloxane structure is effective means for solving the exudation, but of course causes a further reduction in durability.

In view of the foregoing, the inventors of the present invention have attempted to introduce a crosslinked structure while increasing the amount of the segment having the organopolysiloxane structure to be introduced into the resin "A". Then, the inventors have produced a toner particle with the resultant resin "A", and have made detailed investigations on: a relationship between the amount of Si derived from the organopolysiloxane structure in the surface of the toner particle and the environmental stability of the toner; and a relationship between a crosslink density representing the number of crosslinked structures per unit mass of the resin "A" and the durability of the toner.

As a result of the investigations, the inventors have found that setting the amount of Si and the crosslink density within specific ranges enables even a toner left to stand under a severer environment for a long time period to achieve both environmental stability and durability. Thus, the inventors have reached the present invention.

In the present invention, the amount of Si (atomic %) derived from the organopolysiloxane structure of the toner particle, which is measured by X-ray photoelectron spectroscopy (ESCA), is 6.0 or more and 10.0 or less.

In the toner of the present invention, the analysis of the surface composition of the toner particle can be performed by using the ESCA. In the ESCA, an element present in the surface of a sample (region to a depth of about 10 nm) is detected. In addition, the bonding state of elements can be separated by a chemical shift, and in the case of a Si—O bond derived from the organopolysiloxane structure, a peak appears at 101 eV or more and 103 eV or less.

A value for the amount of Si of less than 6.0 atomic % means that the amount of the organopolysiloxane structure in the resin "A" is small. In this case, a suppressing effect on the exudation of the wax or the low-molecular weight component in the core resin due to long-term standing of the toner under a severer environment is not obtained.

In addition, a value for the amount of Si of more than 10.0 atomic % means that the amount of the organopolysiloxane structure in the resin "A" is large. In this case, the surface of the toner particle soften and hence the durability deteriorates.

The value for the amount of Si is more preferably 7.0 atomic % or more and 9.0 atomic % or less.

The resin is a polymer of a monomer composition containing a monomer "a" having two or more polymerizable unsaturated groups in one molecule thereof.

The monomer "a" having two or more polymerizable unsaturated groups in one molecule thereof serves to suppress the softening of the resin "A" due to the compound having the organopolysiloxane structure through the formation of a crosslinked structure at the time of its polymerization.

In addition, the monomer "a" derived from the resin "A" satisfies the following formula (1):

$$(Xa-1.0)\times Ya \geq 3.0\times 10^{-5} \quad (1)$$

in the formula (1), Xa represents an average number of polymerizable unsaturated groups in one molecule of the monomer "a", and Ya represents a number of moles (mol/g) of the monomer "a" with respect to the total mass of all monomers in the monomer composition.

The [(Xa−1.0)×Ya] in the formula (1) represents a crosslink density in the resin "A". A value for the [(Xa−1.0)×Ya] of less than $3.0\times 10^{-5}$ means that the crosslink density in the resin "A" is low. In this case, the surface of the toner particle are liable to soften and hence the durability reduces. Therefore, the value for the [(Xa−1.0)×Ya] needs to be $3.0\times 10^{-5}$ or more, and is more preferably $5.0\times 10^{-5}$ or more.

In addition, from the viewpoint of the maintenance of the fixability of the toner, the value for the [(Xa−1.0)×Ya] is preferably $2.5\times 10^{-4}$ or less, more preferably $2.0\times 10^{-4}$ or less, still more preferably $1.5\times 10^{-4}$ or less.

In the toner particle of the present invention, the average number Xa of polymerizable unsaturated groups in one molecule of the monomer "a" derived from the resin "A" is preferably 2.0 or more and 4.0 or less.

Setting the Xa within the range facilitates the control of the crosslink density in the resin "A" within the range represented by the formula (1). Two or more kinds of the monomers "a" having polymerizable unsaturated groups to be used for introducing a crosslinked structure may be used in combination. In Examples of the present invention, a polyester having a polymerizable unsaturated group and a polyfunctional monomer are used as the monomers "a" having polymerizable unsaturated groups. When two or more kinds of the monomers "a" are used as described above, the value for the [(Xa−1.0)×Ya] is determined in each of the monomers "a" and whether or not the formula (1) is satisfied is judged by summing the resultant values.

The case where the Xa is 2.0 or more means that the amount of the monomer having polymerizable unsaturated groups that is not involved in any crosslinked structure is small. Accordingly, an improving effect on the durability exhibited by the introduction of a crosslinked structure into the resin "A" forming the shell layer in the surface of the toner particle becomes more satisfactory.

Meanwhile, when the Xa is 4.0 or less, an excessive increase in crosslink density by the monomer having polymerizable unsaturated groups is suppressed. Accordingly, the curing of the resin "A" forming the shell layer becomes moderate and hence the low-temperature fixability of the toner becomes satisfactory. The Xa more preferably falls within the range of from 2.0 or more to 3.5 or less.

The content of the resin "A" in the toner particle is preferably 1.0 mass % or more and 10.0 mass % or less.

Improving effects on the environmental stability and the durability can be expressed more effectively by setting the content of the resin "A" within the range. When the content of the resin "A" is 1.0 mass % or more, the durability is further improved. In addition, when the content of the resin "A" is 10.0 mass % or less, the low-temperature fixability becomes satisfactory.

The content of the resin "A" in the toner particle is more preferably 2.0 mass % or more and 5.0 mass % or less.

The toner particle of the present invention preferably has, between the core and the shell layer, an intermediate layer containing a resin "B" containing a segment having an organopolysiloxane structure.

The following condition needs to be satisfied for suppressing the exudation of the wax or the low-molecular weight component in the core resin under a severe environment: the shell layer is uniformly present on the surface of the toner particle, and is in close contact therewith. The formation of the intermediate layer containing the resin "B" between the core and the shell layer improves the adhesiveness of the shell layer in the surface of the toner particle, and hence further enlarges a suppressing effect on the exudation of the wax or the low-molecular weight component in the core resin.

In the toner particle of the present invention, the resin "A" and the resin "B" preferably satisfy the following formula (2):

$$Za > Zb \quad (2)$$

in the formula (2), Za represents an amount of Si of the resin "A" measured by fluorescent X-ray analysis (XRF), and Zb represents an amount of Si of the resin "B" measured by the fluorescent X-ray analysis (XRF).

When the value for the Za is larger than the value for the Zb, the amount of Si in the surface of the toner particle becomes relatively large, and hence an improving effect on the environmental stability becomes more excellent.

The resin "B" is preferably a polymer of a monomer composition containing a monomer "b" having two or more polymerizable unsaturated groups in one molecule thereof. The durability of the toner can be further improved through the formation of a crosslinked structure by the monomer "b" having two or more polymerizable unsaturated groups in one molecule thereof at the time of the polymerization of the resin "B". In addition, the resin "A" and the resin "B" preferably satisfy the following formula (3):

$$(Xa-1.0)\times Ya \geq (Xb-1.0)\times Yb \quad (3)$$

in the formula (3), Xa and Ya are identical in meaning to the Xa and the Ya in the formula (1), respectively, Xb represents an average number of polymerizable unsaturated groups in one molecule of the monomer "b" in the resin "B", and Yb represents a number of moles (mol/g) of the monomer "b" with respect to a total mass of all monomers in the monomer composition in the resin "B".

The [(Xa−1.0)×Ya] and the [(Xb−1.0)×Yb] represent crosslink densities in the resin "A" and the resin "B", respectively.

The case where the value for the [(Xa−1.0)×Ya] is equal to or more than the value for the [(Xb-1.0)×Yb] means that in the toner particle, the crosslink density of the resin "A" constituting the shell layer is higher than the crosslink density of the resin "B" constituting the intermediate layer. Accordingly, an improving effect on the durability of the toner becomes more excellent.

The average number Xb of polymerizable unsaturated groups in one molecule of the monomer "b" in the resin "B" constituting the intermediate layer is preferably 2.0 or more and 4.0 or less.

Setting the Xb within the range facilitates the control of the relationship between the crosslink densities of the resin "A" and the resin "B" within the range represented by the formula (3).

Two or more kinds of the monomers "b" having polymerizable unsaturated groups to be used for introducing a crosslinked structure may be used in combination.

The case where the Xb is 2.0 or more means that the amount of the monomer "b" having polymerizable unsaturated groups that is not involved in any crosslinked structure is small. Accordingly, an improving effect on the durability exhibited by the introduction of a crosslinked structure into the resin "B" forming the intermediate layer between the core and the shell layer becomes satisfactory.

Meanwhile, when the Xb is 4.0 or less, an excessive increase in crosslink density by the monomer "b" having polymerizable unsaturated groups is suppressed. Accordingly, the curing of the resin "B" forming the intermediate layer is controlled to a moderate level and hence the low-temperature fixability becomes satisfactory. The Xb more preferably falls within the range of from 2.0 or more to 3.5 or less.

The content of the resin "B" in the toner particle is preferably 1.0 mass % or more and 10.0 mass % or less.

Setting the content of the resin "B" within the range can more effectively improve the adhesiveness of the resin "B" forming the intermediate layer with the core or the shell layer.

When the content of the resin "B" is 1.0 mass % or more, sufficient adhesiveness is obtained, and hence a suppressing effect on the exudation of the wax or the low-molecular weight component in the core resin under a severe environment is sufficiently obtained.

In addition, when the content of the resin "B" is 10.0 mass % or less, the low-temperature fixability becomes satisfactory. Further, the content is more preferably 3.0 mass % or more and 7.0 mass % or less.

When the content of the resin "A" with respect to the toner particle is represented by Ma (mass %), and the content of the resin "B" with respect to the toner particle is represented by Mb (mass %), the Ma and the Mb preferably satisfy the following formula (4).

$$4.0 \leq Ma+Mb \leq 15.0 \quad (4)$$

The Ma and the Mb represent the amounts of the shell layer and the intermediate layer in the toner particle, respectively. When the sum of the Ma and the Mb is 4.0 mass % or more and 15.0 mass % or less, the total amount of the shell layer and the intermediate layer in the toner particle is controlled to a moderate level, and hence improving effects on the durability and the low-temperature fixability are sufficiently obtained.

Further, the Ma+Mb is more preferably 5.0 mass % or more and 12.0 mass % or less.

The resin is preferably a polymer of a monomer composition containing an organopolysiloxane compound having a vinyl group and the monomer "a" containing a polyester having a polymerizable unsaturated group. The resin "A" preferably satisfies the following formula (5):

$$0.5 \leq Ea/Sa \leq 1.8 \quad (5)$$

in the formula (5), Sa represents a mass of the organopolysiloxane compound having a vinyl group in the monomer composition of the resin "A", and Ea represents a mass of the polyester having a polymerizable unsaturated group in the monomer composition of the resin "A".

When the mass ratio (Ea/Sa) is 0.5 or more, the amount of the segment having the organopolysiloxane structure present in the surface of the toner particle becomes relatively small, and hence an improving effect on the durability of the toner is more easily obtained.

When the mass ratio (Ea/Sa) is 1.8 or less, the amount of the segment having the organopolysiloxane structure present in the surface of the toner particle becomes relatively large, and hence an improving effect on the environmental stability of the charging performance of the toner is easily obtained.

The mass ratio (Ea/Sa) is particularly preferably 0.7 or more and 1.4 or less.

The resin "B" is preferably a polymer of a monomer composition containing an organopolysiloxane compound having a vinyl group and the monomer "b" containing a polyester having a polymerizable unsaturated group. In addition, the resin "B" preferably satisfies the following formula (6):

$$1.0 \leq Eb/Sb \leq 2.3 \quad (6)$$

in the formula (6), Sb represents a mass of the organopolysiloxane compound having a vinyl group in the monomer composition of the resin "B", and Eb represents a mass of the polyester having a polymerizable unsaturated group in the monomer composition of the resin "B".

When the mass ratio (Eb/Sb) is 1.0 or more and 2.3 or less, the segment having the organopolysiloxane structure is present at a moderate ratio in the intermediate layer of the toner particle. As a result, adhesiveness between the core and the intermediate layer is improved, and hence a suppressing effect on the exudation of the wax or the low-molecular weight component in the core resin under a severe environment is sufficiently obtained. Accordingly, an improving effect on the durability of the toner becomes more excellent.

The Ea/Sa in the resin "A" and the Eb/Sb in the resin "B" preferably satisfy the following formula (7).

$$Ea/Sa < Eb/Sb \quad (7)$$

Satisfying the relationship can adjust a balance with the adhesiveness between the core and the intermediate layer, and that between the intermediate layer and the shell layer, and hence can further improve the durability of the toner.

An example of the structure of the organopolysiloxane compound having a vinyl group to be used in the polymerization of each of the resin "A" and the resin "B" in the toner of the present invention is represented by the formula (II). In the formula (II), $R^2$ and $R^3$ each represent an alkyl group, $R^4$ represents an alkylene group, and $R^5$ represents a hydrogen atom or a methyl group. n represents a polymerization degree and represents an integer of 2 or more.

Formula (II)

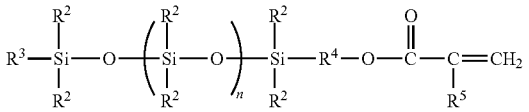

A method of synthesizing the organopolysiloxane compound having a vinyl group is, for example, a reaction based on a dehydrochlorination reaction between a carbinol-modified polysiloxane and acryloyl chloride or methacryloyl chloride.

Examples of a method of producing the polyester having a polymerizable unsaturated group serving as each of the monomer "a" and the monomer "b" to be used in the polymerization of the resin "A" and the resin "B" include the following methods.

(1) A method involving introducing a polymerizable unsaturated group at the time of a polycondensation reaction between a dicarboxylic acid and a diol. Examples of the method involving introducing a polymerizable unsaturated group include the following approaches.

(1-1) A method involving using a dicarboxylic acid having a polymerizable unsaturated group as part of the dicarboxylic acid (1-2) A method involving using a diol having a polymerizable unsaturated group as part of the diol (1-3) A method involving using a dicarboxylic acid having a polymerizable unsaturated group and a diol having a polymerizable unsaturated group as part of the dicarboxylic acid and part of the diol, respectively The degree of unsaturation of the polyester having a polymerizable unsaturated group can be adjusted by the addition amount of the dicarboxylic acid or diol having a polymerizable unsaturated group.

Examples of the dicarboxylic acid having a polymerizable unsaturated group include fumaric acid, maleic acid, 3-hexenedioic acid, and 3-octenedioic acid, and lower alkyl esters and acid anhydrides thereof. Of those, fumaric acid and maleic acid are more preferred from the viewpoint of cost. In addition, examples of the aliphatic diol having a polymerizable unsaturated group can include the following compounds: 2-butene-1,4-diol, 3-hexene-1,6-diol, and 4-octene-1,8-diol.

A dicarboxylic acid or diol to be used in ordinary polyester production to be described later can be used as a dicarboxylic acid or diol free of the polymerizable unsaturated group.

(2) A method involving coupling a polyester produced by polycondensation between a dicarboxylic acid and a diol, and a vinyl-based compound. In the coupling, a vinyl-based compound containing a functional group capable of reacting with a terminal functional group of the polyester may be directly coupled. In addition, the coupling may be performed after a terminal of the polyester has been modified with a binder so as to be capable of reacting with the functional group contained in the vinyl-based compound. Examples thereof include the following methods.

(2-1) A method of coupling a polyester having a carboxyl group at a terminal thereof and a vinyl-based compound containing a hydroxyl group through a condensation reaction. In this case, in the preparation of the polyester, the molar ratio (dicarboxylic acid/diol) of the dicarboxylic acid to the diol is preferably 1.02 or more and 1.20 or less.

(2-2) A method of coupling a polyester having a hydroxyl group at a terminal thereof and a vinyl-based compound containing an isocyanate group through a urethanization reaction.

(2-3) A method of coupling subjecting a polyester having a hydroxyl group at a terminal thereof and a vinyl-based compound having a hydroxyl group through a urethanization reaction with a diisocyanate serving as a binder.

In the preparation of the polyester to be used in the method described in the item (2-2) or the item (2-3), the molar ratio (diol/dicarboxylic acid) of the diol to the dicarboxylic acid is preferably 1.02 or more and 1.20 or less.

Examples of the vinyl-based compound having a hydroxyl group include hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-buten-3-ol, 2-buten-1-ol, 2-butene-1,4-diol, propargyl alcohol, 2-hydroxyethyl propenyl ether, and sucrose allyl ether. Of those, hydroxyethyl acrylate and hydroxyethyl methacrylate are preferred.

Examples of the vinyl-based compound having an isocyanate group include the following: 2-isocyanatoethyl acrylate, 2-isocyanatoethyl methacrylate, 2-(0-[1'-methylpropylideneamino]carboxyamino)ethyl methacrylate, 2-[(3,5-dimethylpyrazolyl)carbonylamino]ethyl methacrylate, and m-isopropenyl-α,α-dimethylbenzyl isocyanate. Of those, 2-isocyanatoethyl acrylate and 2-isocyanatoethyl methacrylate are particularly preferred.

Examples of the diisocyanate include the following: an aromatic diisocyanate having 6 or more and 20 or less carbon atoms (excluding a carbon atom in an NCO group, and the same holds true for the following), an aliphatic diisocyanate having 2 or more and 18 or less carbon atoms, an alicyclic diisocyanate having 4 or more and 15 or less carbon atoms, and modified products of these diisocyanates (modified products each containing a urethane group, a carbodiimide group, an allophanate group, a urea group, a biuret group, a uretdione group, a uretonimine group, an isocyanurate group, or an oxazolidone group, which are hereinafter sometimes referred to as modified diisocyanates).

Examples of the aromatic diisocyanate include the following: m-xylylene diisocyanate (XDI) and α,α,α',α'-tetramethylxylylene diisocyanate.

Examples of the aliphatic diisocyanate include the following: ethylene diisocyanate, tetramethylene diisocyanate, hexamethylene diisocyanate (HDI), and dodecamethylene diisocyanate.

Examples of the alicyclic diisocyanate include the following: isophorone diisocyanate (IPDI), dicyclohexylmethane-4,4'-diisocyanate, cyclohexylene diisocyanate, and methylcyclohexylene diisocyanate.

Of those, XDI, HDI, and IPDI are preferred.

In the toner particle of the present invention, in addition to the polyester having a polymerizable unsaturated group, a general polyfunctional monomer having a plurality of vinyl groups can be used as each of the monomer "a" and the monomer "b" each having two or more polymerizable unsaturated groups in one molecule thereof to be used in the polymerization of the resin "A" and the resin "B".

Available monomers are listed below, but not limited thereto.

Examples of the available monomers include diethylene glycol diacrylate, triethylene glycol diacrylate, tetraethylene glycol diacrylate, polyethylene glycol diacrylate, polypropylene diacrylate, 1,6-hexanediol diacrylate, neopentyl glycol diacrylate, tripropylene glycol diacrylate, polypropylene glycol diacrylate, 2,2'-bis(4-(acryloxy/diethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy/diethoxy)phenyl)propane, 2,2'-bis(4-(methacryloxy/polyethoxy)phenyl)propane, trimethylolpropane trimethacrylate, tetramethylolmethane tetramethacrylate, divinylbenzene, divinylnaphthalene, divinyl ether, polytetramethylene glycol diacrylate, both-terminal acryl-modified silicone, and both-terminal methacryl-modified silicone.

A polyester having two or more polymerizable unsaturated groups in one molecule thereof can also be used.

In the toner particle of the present invention, in addition to the organopolysiloxane compound having a vinyl group, the polyester having a polymerizable unsaturated group, and the polyfunctional monomer, any other monomer can be polymerized for producing a resin constituting each of the resin "A" and the resin "B". A monomer to be used in the polymerization of an ordinary resin material can be used as the other monomer. Examples thereof are listed below, but not limited thereto.

Aliphatic vinyl hydrocarbons: alkenes, such as ethylene, propylene, butene, isobutylene, pentene, heptene, diisobutylene, octene, dodecene, octadecene, and α-olefins except the olefins; and alkadienes, such as butadiene, isoprene, 1,4-pentadiene, 1,6-hexadiene, and 1,7-octadiene.

Alicyclic vinyl hydrocarbons: mono- or di-cycloalkenes and alkadienes, such as cyclohexene, cyclopentadiene, vinylcyclohexene, and ethylidenebicycloheptene; and terpenes, such as pinene, limonene, and indene.

Aromatic vinyl hydrocarbons: styrene and hydrocarbyl (alkyl, cycloalkyl, aralkyl, and/or alkenyl)-substituted products thereof, such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene; and vinylnaphthalene.

Carboxyl group-containing vinyl-based monomers and metal salts thereof: unsaturated monocarboxylic acids and unsaturated dicarboxylic acids each having 3 or more and 30 or less carbon atoms, and anhydrides thereof and monoalkyl (having 1 or more and 27 or less carbon atoms) esters thereof, e.g., carboxyl group-containing vinyl-based monomers, such as acrylic acid, methacrylic acid, maleic acid, maleic anhydride, a maleic acid monoalkyl ester, fumaric acid, a fumaric acid monoalkyl ester, crotonic acid, itaconic acid, an itaconic acid monoalkyl ester, an itaconic acid glycol monoether, citraconic acid, a citraconic acid monoalkyl ester, and cinnamic acid.

Vinyl esters, such as vinyl acetate, vinyl butyrate, vinyl propionate, and vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, ethyl α-ethoxyacrylate, alkyl acrylates and alkyl methacrylates each having a (linear or branched) alkyl group having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, and 2-ethylhexyl methacrylate), a dialkyl fumarate (fumaric acid dialkyl ester) (two alkyl groups are linear, branched, or alicyclic groups each having 2 or more and 8 or less carbon atoms), a dialkyl maleate (maleic acid dialkyl ester) (two alkyl groups are linear, branched, or alicyclic groups each having 2 or more and 8 or less carbon atoms), polyallyloxyalkanes (diallyloxyethane, triallyloxyethane, tetraallyloxyethane, tetraallyloxypropane, tetraallyloxybutane, and tetramethallyloxyethane), vinyl-based monomers each having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (ethylene oxide is hereinafter abbreviated as EO) 10 mol adduct acrylate, methyl alcohol ethylene oxide (ethylene oxide is hereinafter abbreviated as EO) 10 mol adduct methacrylate, lauryl alcohol EO 30 mol adduct acrylate, and lauryl alcohol EO 30 mol adduct methacrylate), and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

In the toner particle of the present invention, any one of a crystalline resin and an amorphous resin serving as resins to be generally used in toner particle can be used as the core resin. The crystalline resin means a resin having a structure in which the molecular chains of a polymer are regularly arranged. Therefore, the resin is substantially free from softening in a temperature region lower than its melting point, but when its temperature exceeds the melting point, its melting occurs and hence the resin abruptly softens. Such resin shows a clear melting point peak in differential scanning calorimetry with a differential scanning calorimeter (DSC). Therefore, the viscosity of the crystalline resin reduces after its melting and hence satisfactory low-temperature fixability is easily expressed.

The melting point of the crystalline resin is preferably 50° C. or more and 90° C. or less.

Examples of the crystalline resin that can be used as the core resin include crystalline polyester, crystalline polyvinyl, crystalline polyurethane, and crystalline polyurea. Of those, crystalline polyester or crystalline polyvinyl is preferred, and crystalline polyester is particularly preferred.

The crystalline polyester is preferably obtained by subjecting an aliphatic diol and an aliphatic dicarboxylic acid to a reaction, and is more preferably obtained by subjecting an aliphatic diol having 2 to 20 carbon atoms and an aliphatic dicarboxylic acid having 2 to 20 carbon atoms to a reaction.

In addition, the aliphatic diol is preferably linear. When the aliphatic diol is linear, polyester having higher crystallinity can be obtained. Examples of the linear aliphatic diol having 2 to 20 carbon atoms include the following compounds: 1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Of those, 1,4-butanediol, 1,5-pentanediol, 1,6-hexanediol, 1,7-heptanediol, 1,8-octanediol, 1,9-nonanediol, or 1,10-decanediol is more preferred from the viewpoint of its melting point. One kind of those diols may be used alone, or two or more kinds thereof may be used as a mixture.

In addition, an aliphatic diol having a double bond can also be used. Examples of the aliphatic diol having a double bond can include the following compounds: 2-butene-1,4-diol, 3-hexene-1,6-diol, and 4-octene-1,8-diol.

In addition, a linear aliphatic dicarboxylic acid is particularly preferred as the aliphatic dicarboxylic acid from the viewpoint of its crystallinity. Examples of the linear aliphatic dicarboxylic acid having 2 to 18 carbon atoms can include the following compounds: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid as well as lower alkyl esters and acid anhydrides thereof. Of those, sebacic acid, adipic acid, or 1,10-decanedicarboxylic acid, or a lower alkyl ester or acid anhydride thereof is preferred. One kind of those dicarboxylic acids may be used alone, or two or more kinds thereof may be mixed and used.

An aromatic dicarboxylic acid can also be used. Examples of the aromatic dicarboxylic acid can include the following compounds: terephthalic acid, isophthalic acid, 2,6-naphthalenedicarboxylic acid, and 4,4'-biphenyldicarboxylic acid.

Of those, terephthalic acid is preferred in terms of the ease of availability and the ease with which a low-melting point polymer is formed.

A dicarboxylic acid having a double bond can also be used. The dicarboxylic acid having a double bond can be suitably used for suppressing a hot offset at the time of fixation because the entirety of the resin can be crosslinked through the utilization of the double bond.

Examples of such dicarboxylic acid include fumaric acid, maleic acid, 3-hexenedioic acid, and 3-octenedioic acid as well as lower alkyl esters and acid anhydrides thereof. Of those, fumaric acid or maleic acid is more preferred from the viewpoint of cost.

A method of producing the crystalline polyester is not particularly limited, and the polyester can be produced by a general polymerization method for a polyester involving causing a carboxylic acid component and an alcohol component to react with each other. For example, the polyester can be produced by properly using a direct polycondensation method or an ester exchange method in accordance with the kinds of its monomers.

The production of the crystalline polyester is preferably performed at a polymerization temperature in the range of from 180° C. or more to 230° C. or less. The reaction is preferably performed while the internal pressure of a reaction system is reduced as required and water or an alcohol to be produced at the time of condensation is removed. When the monomers are not dissolved or made compatible with each other under the reaction temperature, a high-boiling point organic solvent is desirably added as a solubilizing agent to dissolve the monomers. In the case of a polycondensation reaction, the reaction is performed while the solubilizing agent is removed by distillation.

Catalysts that can be used in the production of the crystalline polyester are, for example, the following compounds: titanium catalysts, such as titanium tetraethoxide, titanium tetrapropoxide, titanium tetraisopropoxide, and titanium tetrabutoxide; and tin catalysts, such as dibutyltin dichloride, dibutyltin oxide, and diphenyltin oxide.

The crystalline polyvinyl is, for example, a resin obtained by polymerizing a vinyl-based monomer containing a linear alkyl group in its molecular structure.

An alkyl acrylate or alkyl methacrylate whose alkyl group has 12 or more carbon atoms is preferred as the vinyl-based monomer containing a linear alkyl group in its molecular structure. Examples thereof can include the following: lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, and behenyl methacrylate.

With regard to a method of producing the crystalline polyvinyl, the polymerization is preferably performed at a temperature of 40° C. or more, or in general, 50° C. or more and 90° C. or less.

The amorphous resin does not show any clear highest endothermic peak in differential scanning calorimetry. The glass transition point (Tg) of the amorphous resin is preferably 50° C. or more and 130° C. or less, more preferably 55° C. or more and 110° C. or less.

Specific examples of the amorphous resin include amorphous polyester, amorphous polyurethane, amorphous polyvinyl, and amorphous polyurea. In addition, those resins may each be modified with urethane, urea, or epoxy. Of those, amorphous polyester, amorphous polyurethane, and amorphous polyvinyl are suitable from the viewpoint of elasticity maintenance, and amorphous polyester is particularly suitable.

The amorphous polyester is described below. Monomers that can be used in the production of the amorphous polyester are, for example, a conventionally known carboxylic acid that is divalent or trivalent or more, and a conventionally known alcohol that is dihydric or trihydric or more. Specific examples of those monomers include the following monomers.

Examples of the divalent carboxylic acid can include the following compounds: dibasic acids, such as succinic acid, adipic acid, sebacic acid, phthalic acid, isophthalic acid, terephthalic acid, malonic acid, and dodecenylsuccinic acid, and anhydrides or lower alkyl esters thereof; and aliphatic unsaturated dicarboxylic acids, such as maleic acid, fumaric acid, itaconic acid, and citraconic acid.

In addition, examples of the trivalent or more carboxylic acid can include the following compounds: 1,2,4-benzenetricarboxylic acid, 1,2,5-benzenetricarboxylic acid, and anhydrides or lower alkyl esters thereof. One kind of those carboxylic acids may be used alone, or two or more kinds thereof may be used in combination.

Examples of the dihydric alcohol can include the following compounds: alkylene glycols (ethylene glycol, 1,2-propylene glycol, and 1,3-propylene glycol); alkylene ether glycols (polyethylene glycol and polypropylene glycol); an alicyclic diol (1,4-cyclohexanedimethanol); a bisphenol (bisphenol A); and alkylene oxide (ethylene oxide and propylene oxide) adducts of an alicyclic diol.

An alkyl moiety of each of the alkylene glycol and alkylene ether glycol may be linear or branched. In the present invention, the alkylene glycol having a branched structure can also be preferably used.

In addition, examples of the trihydric or more alcohol may include the following compounds: glycerin, trimethylolethane, trimethylolpropane, and pentaerythritol. One kind of those alcohols may be used alone, or two or more kinds thereof may be used in combination.

Monovalent acids, such as acetic acid and benzoic acid, and monohydric alcohols, such as cyclohexanol and benzyl alcohol, can also each be used as required for the purpose of adjusting the acid value or hydroxyl value of the amorphous polyester.

A method of synthesizing the amorphous polyester is not particularly limited, but for example, an ester exchange method and a direct polycondensation method can each be used alone, or can be used in combination.

Next, the amorphous polyurethane is described.

The polyurethane is a product of a reaction between a diol and a compound having a diisocyanate group, and a polyurethane having various kinds of functionality can be obtained by adjusting the diol and the diisocyanate.

The same diisocyanate as the diisocyanate that can be used in the production of the polyester having a polymerizable unsaturated group can be used.

In addition to the diisocyanate, an isocyanate compound that is trifunctional or more can also be used.

The same alcohol as the dihydric alcohol that can be used in the production of the amorphous polyester can be adopted as the diol.

The amorphous polyvinyl is described below. The following compounds can be given as monomers that can be used in the production of the amorphous polyvinyl.

Aliphatic vinyl hydrocarbons: alkenes (ethylene, propylene, butene, isobutylene, pentene, heptene, diisobutylene, octene, dodecene, octadecene, and α-olefins except the olefins); and alkadienes (butadiene, isoprene, 1,4-pentadiene, 1,6-hexadiene, and 1,7-octadiene).

Alicyclic vinyl hydrocarbons: mono- or di-cycloalkenes and alkadienes (cyclohexene, cyclopentadiene, vinylcyclohexene, and ethylidenebicycloheptene); and terpenes (pinene, limonene, and indene).

Aromatic vinyl hydrocarbons: styrene and hydrocarbyl (alkyl, cycloalkyl, aralkyl, and/or alkenyl)-substituted products thereof (α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene); and vinylnaphthalene.

Carboxyl group-containing vinyl monomers and metal salts thereof: unsaturated monocarboxylic acids and unsaturated dicarboxylic acids each having 3 or more and 30 or less carbon atoms, and anhydrides thereof and monoalkyl [having 1 or more and 11 or less carbon atoms] esters thereof (such as maleic acid, maleic anhydride, a maleic acid monoalkyl ester, fumaric acid, a fumaric acid monoalkyl ester, crotonic acid, itaconic acid, an itaconic acid monoalkyl ester, an itaconic acid glycol monoether, citraconic acid, a citraconic acid monoalkyl ester, and carboxyl group-containing vinyl-based monomers of cinnamic acid).

Vinyl esters (vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxyacetate, vinyl benzoate, and ethyl α-ethoxyacrylate), alkyl acrylates and alkyl methacrylates each having a (linear or branched) alkyl group having 1 or more and 11 or less carbon atoms (methyl acrylate, methyl methacrylate, ethyl acrylate, ethyl methacrylate, propyl acrylate, propyl methacrylate, butyl acrylate, butyl methacrylate, 2-ethylhexyl acrylate, and 2-ethylhexyl methacrylate), a dialkyl fumarate (fumaric acid dialkyl ester) (two alkyl groups are linear, branched, or alicyclic groups each having 2 or more and 8 or less carbon atoms), a dialkyl maleate (maleic acid dialkyl ester) (two alkyl groups are linear, branched, or alicyclic groups each having 2 or more and 8 or less carbon atoms), polyallyloxyalkanes (diallyloxyethane, triallyloxyethane, tetraallyloxyethane, tetraallyloxypropane, tetraallyloxybutane, and tetramethallyloxyethane), vinyl-based monomers each having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (ethylene oxide is hereinafter abbreviated as EO) 10 mol adduct acrylate, methyl alcohol ethylene oxide (ethylene oxide is hereinafter abbreviated as EO) 10 mol adduct methacrylate, lauryl alcohol EO 30 mol adduct acrylate, and lauryl alcohol EO 30 mol adduct methacrylate), and polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Further, in the present invention, the use of a block polymer obtained by chemically bonding a crystalline resin component and an amorphous resin component as the resin "A" is also one preferred mode.

Examples of the block polymer include an XY type diblock polymer, an XYX type triblock polymer, a YXY type triblock polymer, and an XYXY . . . type multiblock polymer, where X represents the crystalline resin component and Y represents the amorphous resin component, and any one of these forms can be used.

The following methods can each be used as a method of preparing the block polymer: a method involving separately preparing a component forming the crystalline resin and a component forming the amorphous resin, and bonding both the components (two-stage method); and a method involving simultaneously loading raw materials for the component forming the crystalline resin and the component forming the amorphous resin to prepare the block polymer in one stage (one-stage method).

The block polymer can be prepared by a method selected from various methods in consideration of the reactivity of each of the terminal functional groups of the block polymer.

When both the crystalline resin component and the amorphous resin component are polyester, the block polymer can be prepared by separately preparing the respective components and then bonding the components with a binder as required. Particularly when one of the polyesters has a high acid value and the other polyester has a high hydroxyl value, the components can be bonded without the use of any binder. At this time, the reaction is preferably performed at a temperature around 200° C.

When the binder is used, examples thereof include the following binders: a polyvalent carboxylic acid, a polyhydric alcohol, a polyvalent isocyanate, a polyfunctional epoxy, and a polyvalent acid anhydride. The block polymer can be synthesized with any such binder by a dehydration reaction or an addition reaction.

When the crystalline resin component is polyester and the amorphous resin component is polyurethane, the block polymer can be prepared by separately preparing the respective components, and then subjecting an alcohol terminal of the polyester and an isocyanate terminal of the polyurethane to a urethanization reaction. In addition, the block polymer can be synthesized by mixing the polyester having an alcohol terminal, and a diol and diisocyanate constituting the polyurethane, and heating the mixture. At the initial stage of a reaction where diol and diisocyanate concentrations are high, the diol and the diisocyanate selectively react with each other to provide the polyurethane. After the molecular weight of the polyurethane has increased to some extent, the urethanization reaction between the isocyanate terminal of the polyurethane and the alcohol terminal of the polyester occurs. Thus, the block polymer can be obtained.

When both the crystalline resin component and the amorphous resin component are polyvinyl, the block polymer can be prepared by polymerizing one of the components and then initiating the polymerization of the other component from a terminal of the resultant vinyl polymer.

The ratio of the crystalline resin component in the block polymer is preferably 50.0 mass % or more, more preferably 70.0 mass % or more.

In the toner of the present invention, the following mode is also one preferred mode: the toner particle contains a wax. The wax is not particularly limited but examples thereof include the following waxes.

Aliphatic hydrocarbon-based waxes, such as low-molecular weight polyethylene, low-molecular weight polypropylene, a low-molecular weight olefin copolymer, a microcrystalline wax, a paraffin wax, and a Fischer-Tropsch wax; an oxide of an aliphatic hydrocarbon-based wax, such as a polyethylene oxide wax; a wax containing a fatty acid ester as a main component, such as an aliphatic hydrocarbon-based ester wax; and a wax obtained by deacidifying part or all of fatty acid esters, such as a deacidified carnauba wax; a partially esterified product of a fatty acid and a polyhydric alcohol, such as behenic acid monoglyceride; and a methyl ester compound having a hydroxyl group obtained by subjecting a vegetable oil and fat to hydrogenation.

Of those, in the toner of the present invention, an aliphatic hydrocarbon-based wax and an ester wax are preferably used in the toner particle. In addition, the ester wax used in the present invention is preferably a trifunctional or more ester wax, more preferably a tetrafunctional or more ester wax, particularly preferably a hexafunctional or more ester wax.

The trifunctional or more ester wax is obtained by, for example, the condensation of an acid that is trivalent or more and a long-chain linear saturated alcohol, or the synthesis of an alcohol that is trihydric or more and a long-chain linear saturated fatty acid.

Examples of the trihydric or more alcohol that can be used in the wax can include, but not limited to, the following alcohols. In some cases, two or more of the alcohols can be used as a mixture. There are given glycerin, trimethylolpropane, erythritol, pentaerythritol, and sorbitol. In addition, as condensates thereof, there are given, for example: so-called polyglycerins, such as diglycerin, triglycerin, tetraglycerin, hexaglycerin, and decaglycerin, which are condensates of glycerin; ditrimethylolpropane and tristrimethylolpropane, which are condensates of trimethylolpropane; and dipentaerythritol and trispentaerythritol, which are condensates of pentaerythritol. Of those, a structure having a branched structure is preferred, pentaerythritol or dipentaerythritol is more preferred, and dipentaerythritol is particularly preferred.

The long-chain linear saturated aliphatic acid is represented by a general formula $C_nH_{2n+1}COOH$, and an acid in which n represents 5 or more and 28 or less is preferably used.

Examples thereof can include, but not limited to, the following acids. In some cases, two or more of the acids can be used as a mixture. There are given caproic acid, caprylic acid, octylic acid, nonylic acid, decanoic acid, dodecanoic acid, lauric acid, tridecanoic acid, myristic acid, palmitic acid, stearic acid, and behenic acid. Of those, myristic acid, palmitic acid, stearic acid, and behenic acid are preferred from the viewpoint of the melting point of the wax.

Examples of the trivalent or more acid that can be used in the present invention can include, but not limited to, the following acids. In some cases, two or more of the acids can be used as a mixture. There are given trimellitic acid and butanetetracarboxylic acid.

The long-chain linear saturated alcohol is represented by $C_nH_{2n+1}OH$, and an alcohol in which n represents 5 or more and 28 or less is preferably used.

Examples thereof can include, but not limited to, the following alcohols. In some cases, two or more of the alcohols can be used as a mixture. There are given capryl alcohol, lauryl alcohol, myristyl alcohol, palmityl alcohol, stearyl alcohol, and behenyl alcohol. Of those, myristyl alcohol, palmityl alcohol, stearyl alcohol, and behenyl alcohol are preferred from the viewpoint of the melting point of the wax.

The addition amount of the wax in the toner particle is preferably 1.0 part by mass or more and 20.0 parts by mass or less, more preferably 2.0 parts by mass or more and 15.0 parts by mass or less with respect to 100 parts by mass of the toner particle.

The wax preferably has a highest endothermic peak at 60° C. or more and 120° C. or less in measurement with a differential scanning calorimeter (DSC). The wax more preferably has the peak at 60° C. or more and 90° C. or less.

The toner particle contains a colorant. Examples of the colorant that is preferably used in the present invention include an organic pigment, an organic dye, an inorganic pigment, carbon black serving as a black colorant, and a magnetic particle. In addition to the foregoing, a colorant that has hitherto been used in a toner can be used.

Examples of the yellow colorant include the following: a condensed azo compound, an isoindolinone compound, an anthraquinone compound, an azo metal complex, a methine compound, and an arylamide compound. Specifically, C.I. Pigment Yellow 12, 13, 14, 15, 17, 62, 74, 83, 93, 94, 95, 109, 110, 111, 128, 129, 147, 155, 168, and 180 are suitably used.

Examples of the magenta colorant include the following: a condensed azo compound, a diketopyrrolopyrrole compound, anthraquinone, a quinacridone compound, a base dye lake compound, a naphthol compound, a benzimidazolone compound, a thioindigo compound, and a perylene compound. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254 are suitably used.

Examples of the cyan colorant include the following: a copper phthalocyanine compound and derivatives thereof, an anthraquinone compound, and a base dye lake compound. Specifically, C.I. Pigment Blue 1, 7, 15, 15:1, 15:2, 15:3, 15:4, 60, 62, and 66 are suitably used.

In the toner of the present invention, the colorant to be used in the toner particle is selected from the viewpoints of a hue angle, chroma, lightness, light fastness, OHP transparency, and dispersibility in the toner particle.

The colorant is preferably used by being added in an amount of 1.0 part by mass or more and 20.0 parts by mass or less with respect to 100 parts by mass of the toner particle. When the magnetic particle is used as the colorant, the addition amount is preferably 40.0 parts by mass or more and 150.0 parts by mass or less with respect to 100 parts by mass of the toner particle.

A charge control agent may be incorporated into the toner particle as required, or may be externally added to the toner particle. The blending of the charge control agent can control triboelectric charge quantity of the toner to an optimum value in accordance with a developing system.

A known charge control agent can be utilized as the charge control agent, and a charge control agent having a high charging speed and capable of stably maintaining a constant charge quantity is particularly preferred.

Examples of the charge control agent that controls the toner particle so as to be negatively chargeable include the following compounds. An organometallic compound and a chelate compound are effective, and examples thereof include a monoazo metal compound, an acetylacetone metal compound, and aromatic oxycarboxylic acid-, aromatic dicarboxylic acid-, oxycarboxylic acid-, and dicarboxylic acid-based metal compounds. Examples of the charge control agent that controls the toner particle so as to be positively chargeable include the following compounds: nigrosine, a quaternary ammonium salt, a metal salt of a higher fatty acid, diorganotin borates, a guanidine compound, and an imidazole compound.

The blending amount of the charge control agent is preferably 0.01 part by mass or more and 20.0 parts by mass or less, more preferably 0.5 part by mass or more and 10.0 parts by mass or less with respect to 100 parts by mass of the toner particle.

In the toner of the present invention, an inorganic fine particle is preferably added as a flowability improver to the toner particle. Examples of the inorganic fine particle to be added to the toner particle includes fine particles, such as a silica fine particle, a titanium oxide fine particle, an alumina fine particle, and double oxide fine particles thereof. Of the inorganic fine particles, a silica fine particle and a titanium oxide fine particle are preferred.

Examples of the silica fine particles include dry silica or fumed silica produced by the vapor phase oxidation of a silicon halide and wet silica produced from water glass. Of those, dry silica is more preferred. In addition, the dry silica may be composite fine particles of silica and any other metal oxide produced by using a metal halide, such as aluminum chloride or titanium chloride, together with a silicon halide in the production process for the dry silica.

The inorganic fine particle is preferably externally added to the toner particle for improving the flowability of the toner and uniformizing the charging of the toner. In addition, the adjustment of the charge quantity of the toner and an improvement in its environmental stability can be achieved by subjecting the inorganic fine particles to the hydrophobic treatment.

In the toner of the present invention, a method of producing the toner particle is not particularly limited, but examples thereof include a dissolution suspension method, a suspension polymerization method, an emulsion aggregation method, and a pulverization method. Of those, a dissolution suspension method by which toner particle having a core-shell structure can be easily prepared is preferred, and a dissolution suspension method involving using a nonaqueous dispersion medium is particularly preferred.

Toner particle by the dissolution suspension method involving using a nonaqueous dispersion medium can be produced in accordance with the following steps:

(a) the step of mixing a core resin and an organic solvent that can dissolve the core resin to prepare a resin solution;

(b) the step of mixing the resin solution, resin fine particles, and a dispersion medium containing carbon dioxide in a high-pressure state to form droplets of the resin solution having the resin fine particles adhering to their surfaces; and (c) the step of removing the organic solvent in each of the droplets to form shells derived from the resin fine particles on the surfaces of cores each containing the core resin to provide the toner particle.

In this case, the carbon dioxide in a high-pressure state is preferably carbon dioxide having a pressure of 1.5 MPa or more. In addition, carbon dioxide in a liquid or supercritical state may be used alone as the dispersion medium, or an organic solvent may be incorporated as any other component. In this case, the carbon dioxide in a high-pressure state and the organic solvent preferably form a homogeneous phase.

A method of producing the toner particle involving using a dispersion medium containing carbon dioxide in a high-pressure state suitable as the production methods of the present invention is given as an example and described below.

First, in the step (a), the colorant and the wax, and as required, any other additive are added to the organic solvent capable of dissolving the core resin, and are homogeneously dissolved or dispersed with a dispersing machine, such as a homogenizer, a ball mill, a colloid mill, or an ultrasonic dispersing machine.

Next, in the step (b), the resin solution thus obtained and the carbon dioxide in a high-pressure state are mixed to form the droplets of the resin solution.

At this time, a dispersant needs to be dispersed in the dispersion medium containing the carbon dioxide in a high-pressure state. The dispersant is, for example, a resin fine particle.

In addition, a dispersion stabilizer in a liquid state may be added. Examples of the dispersion stabilizer include: a compound containing the organopolysiloxane structure or fluorine, the compound having a high affinity for carbon dioxide; and various surfactants, such as a nonionic surfactant, an anionic surfactant, and a cationic surfactant. Any such dispersion stabilizer is discharged to the outside of a system together with carbon dioxide in a desolvating step to be described later. Therefore, after the production of the toner particle, the amount of the dispersion stabilizer remaining in the toner particle becomes extremely small.

As a method of dispersing the dispersant in the dispersion medium containing the carbon dioxide in a high-pressure state, there is given, for example, a method involving loading the dispersant and the dispersion medium containing the carbon dioxide in a high-pressure state into a container, and directly dispersing the dispersant through stirring or ultrasonic irradiation. There is also given, for example, a method involving introducing, into a container loaded with the dispersion medium containing the carbon dioxide in a high-pressure state, a dispersion liquid, which is obtained by dispersing the dispersant in the organic solvent, with a high-pressure pump.

In addition, in the present invention, as a method of dispersing the resin solution in the dispersion medium containing the carbon dioxide in a high-pressure state, there is given, for example, a method involving introducing, into a container loaded with the dispersion medium containing the carbon dioxide in a high-pressure state, the dispersion medium being in a state in which the dispersant has been dispersed therein, the resin solution with a high-pressure pump. In addition, the dispersion medium containing the carbon dioxide in a high-pressure state, the dispersion medium being in a state in which the dispersant has been dispersed therein, may be introduced into a container loaded with the resin solution.

In the present invention, it is important that the dispersion medium containing the carbon dioxide in a high-pressure state be of a single phase. When granulation is performed by dispersing the resin solution in the carbon dioxide in a high-pressure state, part of the organic solvent in each of the droplets migrates to the inside of a dispersion. At this time, a situation where the phase of the carbon dioxide and the phase of the organic solvent are present under a state of being separated from each other is not preferred because the situation is responsible for the impairment of the stability of the droplets.

Therefore, the temperature and pressure of the dispersion medium, and the amount of the resin solution with respect to the carbon dioxide in a high-pressure state are preferably adjusted to fall within such ranges that the carbon dioxide and the organic solvent can form a homogeneous phase.

In addition, with regard to the temperature and pressure of the dispersion medium, attention needs to be paid to a granulation property (the case with which the droplets are formed) and the solubility of each constituent component in the resin solution in the dispersion medium. For example, the core resin and the wax in the resin solution may dissolve in the dispersion medium depending on a temperature condition and a pressure condition. In general, as the temperature and pressure of the dispersion medium reduce, the solubility of each of the components in the dispersion medium is suppressed, but the formed droplets are liable to agglomerate and coalesce, thereby reducing the granulation property. On the other hand, as the temperature and the pressure increase, the granulation property improves but the following tendency is observed: the components are liable to dissolve in the dispersion medium. Therefore, in the production of the toner particle, the temperature of the dispersion medium preferably falls within the temperature range of from 10° C. or more to 40° C. or less.

In addition, the internal pressure of a container where the droplets are formed is preferably 1.5 MPa or more and 20.0 MPa or less, more preferably 2.0 MPa or more and 15.0 MPa or less. When the dispersion medium contains a component except the carbon dioxide, the pressure in the present invention means the total pressure of the components in the dispersion medium.

After the formation of the droplets has thus been completed, in the step (c), the organic solvent remaining in each of the droplets is removed through the dispersion medium based on the carbon dioxide in a high-pressure state. Specifically, the removal is performed by: further mixing the dispersion medium having dispersed therein the droplets with the carbon dioxide in a high-pressure state to extract the remaining organic solvent to the phase of the carbon dioxide; and further replacing the carbon dioxide containing the organic solvent with the carbon dioxide in a high-pressure state.

With regard to the mixing of the dispersion medium and the carbon dioxide in a high-pressure state, carbon dioxide having a higher pressure than that of the dispersion medium may be added to the dispersion medium, or the dispersion medium may be added to carbon dioxide having a lower pressure than that of the dispersion medium.

In addition, a method of further replacing the carbon dioxide containing the organic solvent with the carbon dioxide in a high-pressure state is, for example, a method involving flowing the carbon dioxide in a high-pressure state while keeping the pressure in the container constant. At this time, the replacement is performed while the toner particle to be formed is captured with a filter.

When the replacement with the carbon dioxide in a high-pressure state is insufficient and hence the organic solvent is in a state of remaining in the dispersion medium, in the decompression of the container for recovering the resultant toner particle, the following inconvenience may occur: the organic solvent dissolved in the dispersion medium condenses to cause the redissolution of the toner particle, or to cause the coalescence of the toner particle. Therefore, the replacement with the carbon dioxide in a high-pressure state needs to be performed until the organic solvent is completely removed. The amount of the carbon dioxide in a high-pressure state to be flowed is preferably 1 times or more and 100 times or less, more preferably 1 times or more and 50 times or less, most preferably 1 times or more and 30 times or less as large as the volume of the dispersion medium.

When the toner particle is removed from the dispersion containing the carbon dioxide in a high-pressure state, the dispersion having dispersed therein the toner particle, by decompressing the container, the container may be decompressed to normal temperature and normal pressure in one stroke, or the decompression may be performed in a stepwise manner by arranging a plurality of containers whose pressures have been independently controlled. A decompression rate is preferably set to fall within such a range that the toner particle is prevented from foaming.

The organic solvent and carbon dioxide to be used in the above-mentioned production method can be recycled.

Toner particle by the dissolution suspension method involving using an aqueous dispersion medium can be produced in accordance with the following steps:

(d) the step of mixing a core resin and an organic solvent that can dissolve the core resin to prepare a resin solution;

(e) the step of mixing and dispersing the resin solution in the aqueous dispersion medium having dispersed therein resin fine particles to form droplets of the resin solution having the resin fine particles adhering to their surfaces; and (f) the step of removing the organic solvent in each of the droplets to form shells derived from the resin fine particles on the surfaces of cores each containing the core resin to provide the toner particle.

Water may be used alone as the aqueous medium, but a solvent miscible with water can be used in combination with water. Examples of the miscible solvent include alcohols (methanol, isopropanol, and ethylene glycol), dimethylformamide, tetrahydrofuran, cellosolves (methyl cellosolve), and lower ketones (acetone and 1-butanone).

In addition, a dispersant is added to the aqueous medium. In addition to the resin fine particles described above, any known surfactant, polymer dispersant, and inorganic fine particles may be used as the dispersant.

Examples of the surfactant include an anionic surfactant, a cationic surfactant, an ampholytic surfactant, and a nonionic surfactant, and the surfactant can be optionally selected depending on polarity in the formation of the toner particle.

Examples of the anionic surfactant include an alkylbenzene sulfonate, an α-olefin sulfonate, and a phosphate ester.

In addition, examples of the cationic surfactant include an salt of aliphatic primary, secondary, or tertiary amine having a fluoroalkyl group, an aliphatic quaternary ammonium salt, such as a perfluoroalkyl(C6-C10)sulfonamide propyltrimethylammonium salt, a benzalkonium salt, benzethonium chloride, a pyridinium salt, and an imidazolinium salt.

In addition, examples of the nonionic surfactant include a fatty acid amide derivative and a polyhydric alcohol derivative.

Examples of the ampholytic surfactant include alanine, dodecyldi(aminoethyl)glycine, di(octylaminoethyl)glycine, and N-alkyl-N,N-dimethylammonium betaine.

In addition, a polymer dispersant may be used as the dispersant. Examples of the polymer dispersant include polymers of acids, such as acrylic acid, methacrylic acid, α-cyanoacrylic acid, α-cyanomethacrylic acid, itaconic acid, crotonic acid, fumaric acid, maleic acid, and maleic anhydride. Alternatively, examples thereof include polymers of acrylic monomers and methacrylic monomers each containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate ester, diethylene glycol monomethacrylate ester, glycerin monoacrylate ester, glycerin monomethacrylate ester, N-methylol acrylamide, and N-methylol methacrylamide. In addition, examples thereof include polymers of vinyl alcohol and ethers with vinyl alcohol, such as vinyl methyl ether, vinyl ethyl ether, and vinyl propyl ether. Further, examples thereof include polymers of esters of vinyl alcohol and compounds each containing a carboxyl group, such as vinyl acetate, vinyl propionate, and vinyl butyrate, and acrylamide, methacrylamide, and diacetone acrylamide. In addition, examples thereof include polymers of acid chlorides, such as acrylic chloride and methacrylic chloride. Further, examples thereof include homopolymers and copolymers each having a nitrogen atom of vinylpyridine, vinylpyrrolidone, vinylimidazole, or ethylenimine, or a heterocycle thereof.

In addition, as other polymer dispersants, there are given, for example, polyoxyethylene-based compounds, such as polyoxyethylene, polyoxypropylene, polyoxyethylene alkylamines, polyoxypropylene alkylamines, polyoxyethylene alkylamides, polyoxypropylene alkylamides, polyoxyethylene nonyl phenyl ether, polyoxyethylene lauryl phenyl ether, polyoxyethylene stearyl phenyl ester, and polyoxyethylene nonyl phenyl ester. In addition, celluloses, such as methyl cellulose, hydroxyethyl cellulose, and hydroxypropyl cellulose, can also be used as other polymer dispersants.

It is preferred that the inorganic fine particles serving as the dispersant can be removed by an acid having no affinity for a solvent because the toner particle is granulated under a state in which the toner particle adheres to the surfaces of the particles after dispersion, and for example, calcium carbonate, calcium chloride, sodium hydrogen carbonate, potassium hydrogen carbonate, sodium hydroxide, potassium hydroxide, hydroxyapatite, and tribasic calcium phosphate can be used.

When a dispersant except the resin fine particles is used, the dispersant can be left remaining on the surface of the toner particle, but is preferably removed by washing in terms of the charging of the toner particle.

In addition, in the present invention, it is also preferred that a surfactant effect be expressed by dissociating a carboxylic acid residue of the polyester in the core resin. Specifically, the carboxylic acid of the polyester can be dissociated by causing an amine to be present in the oil phase or aqueous phase. The amine that can be used at this time is preferably an amine having a relatively low molecular weight, such as ammonia water, triethylamine, or triethanolamine.

An apparatus used for the method of dispersing the resin solution in the dispersion medium is not particularly limited, and a general-purpose apparatus, such as a low-speed shearing type, high-speed shearing type, friction type, high-pressure jet type, or ultrasonic apparatus, can be used. Of those, a high-speed shearing type apparatus is preferred, and an apparatus that has been used as an emulsifier or a dispersing machine for general purposes can be used.

Examples thereof include: a continuous emulsifier, such as ULTRA-TURRAX (manufactured by IKA Works Inc.), Polytron (manufactured by Kinematica Inc.), T.K. HOMOMIXER (manufactured by Tokushu Kika Kogyo Co., Ltd.), Ebara Milder (manufactured by Ebara Corporation), TK-HOMOMIC LINE FLOW (manufactured by Tokushu Kika Kogyo Co., Ltd.), Colloid Mill (manufactured by Shinko Pantech Co., Ltd.), Slasher, Trigonal wet milling machine (manufactured by Mitsui Miike Chemical Engineering Machinery, Co., Ltd.), Cavitron (manufactured by Eurotech Co., Ltd.), or Fine-Flow Mill (manufactured by Pacific Machinery & Engineering Co., Ltd.); and a batch-type or continuous dual emulsifier, such as Clearmix (manufactured by M Technique Co., Ltd.) or FILMICS (manufactured by Tokushu Kika Kogyo Co., Ltd.).

When the high-speed shearing type dispersing machine is used, its number of revolutions, which is not particularly limited, is typically 1,000 rpm or more and 30,000 rpm or less, preferably 3,000 rpm or more and 20,000 rpm or less. In the case of a batch-type machine, a dispersion time is typically 0.1 minute or more and 5 minutes or less. A temperature at the time of dispersion is typically 10° C. or more and 55° C. or less, preferably 10° C. or more and 40° C. or less.

When an intermediate layer is formed, the intermediate layer can be formed by mixing a plurality of resin fine particles different from each other in kind in the dispersion medium in each of the step (b) and the step (e).

In the present invention, the intermediate layer is preferably formed by adding, after the preparation of a dispersion liquid having dispersed therein the droplets of the resin solution covered with the resin fine particles in each of the step (b) and the step (e), other resin fine particles different from the resin fine particles. In addition, in this case, the addition of the other resin fine particles may be performed between the step (b) and the step (c), or between the step (e) and the step (f), may be performed during the removal of the organic solvent in each of the step (c) and the step (f), or may be performed after the removal.

In the present invention, a layer construction to be formed in the toner particle comes in the following types:

(i) a monolayer type formed of the core and the shell layer;

(ii) a two-layer type formed of the core, the intermediate layer, and the shell layer; and (iii) a multilayer type formed of the core, a plurality of intermediate layers, and the shell layer.

In the case of the (i), resin fine particles each containing the resin "A" form the shell layer as a single layer. Therefore, the resin fine particles each containing the resin "A" are used as the resin fine particles to be used in each of the step (b) and the step (e).

In the case of the (ii), the resin fine particles each containing the resin "A" form the shell layer, and resin fine particles each containing the resin "B" form the intermediate layer. Therefore, the resin fine particles each containing the resin "B" are used in each of the step (b) and the step (e), and the resin fine particles each containing the resin "A" are used as the resin fine particles to be added later.

In the case of the (iii), the resin fine particles each containing the resin "A" form the shell layer, and the resin fine particles each containing the resin "B" form a layer closest to the core. The number of many layers to be formed therebetween is not limited, and the resin fine particles to be used may be the resin fine particles each containing the resin "B", or may be the resin fine particles each containing the resin "A". Resin fine particles except the foregoing may also be used. However, in the case where the resin fine particles except the resin fine particles each containing the resin "A" and the resin fine particles each containing the resin "B" are used, the amount of Si of the resin in each of the resin fine particles measured by XRF needs to be adjusted so as to be the Za or less and the Zb or more. In addition, in this case, the resin fine particles each containing the resin "B" are used in each of the step (b) and the step (e). The resin fine particles to be added later need only to be added in several portions, and the resin fine particles each containing the resin "A" need only to be used as at least the resin fine particles to be finally added.

The weight-average particle diameter (D4) of the toner particle of the present invention is preferably 3.0 μm or more and 8.0 μm or less, more preferably 5.0 μm or more and 7.0 μm or less. The toner particle having such weight-average particle diameter (D4) are preferably used for sufficiently satisfying dot reproducibility while making the handleability of the toner satisfactory. The ratio (D4/D1) of the weight-average particle diameter (D4) of the resultant toner particle to the number-average particle diameter (D1) thereof is preferably less than 1.30.

Methods of measuring respective physical property values specified in the present invention are described below.

<Measurement Method for Weight-Average Particle Diameter (D4) and Number-Average Particle Diameter (D1) of Toner Particle>

The weight-average particle diameter (D4) and number-average particle diameter (D1) of the toner particle are calculated as described below. A precision particle size distribution measuring apparatus based on a pore electrical resistance method provided with a 100 μm aperture tube "Coulter Counter Multisizer 3" (trademark, manufactured by Beckman Coulter, Inc.) is used as a measuring apparatus. Dedicated software included with the apparatus "Beckman Coulter Multisizer 3 Version 3.51" (manufactured by Beckman Coulter, Inc.) is used for setting measurement conditions and analyzing measurement data. The measurement is performed at a number of effective measurement channels of 25,000.

An electrolyte aqueous solution prepared by dissolving reagent grade sodium chloride in ion-exchanged water so as to have a concentration of about 1 mass %, for example, "ISOTON II" (manufactured by Beckman Coulter, Inc.) can be used in the measurement.

The dedicated software is set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level" button. In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method for measuring the weight-average particle diameter (D4) and the number-average particle diameter (D1) of the toner particle is disclosed in Japanese Patent Application Laid-Open No. 2012-042939.

<Method of Measuring Average Number Xa of Polymerizable Unsaturated Groups in One Molecule of Polyester Having Polymerizable Unsaturated Group Serving as Each of Monomer "a" and Monomer "b">

The measurement of the average number of polymerizable unsaturated groups in a polyester having a polymerizable unsaturated group serving as each of the monomer "a" and the monomer "b" is performed by $^1$H-NMR under the following conditions.

Measuring apparatus: FT NMR apparatus JNM-EX400 (manufactured by JEOL Ltd.)
Measuring frequency: 400 MHz
Pulse condition: 5.0 μs
Frequency range: 10,500 Hz
Cumulated number: 64 times
Measuring temperature: 30.0° C.

A sample is prepared by: loading 50.0 mg of the polyester having a polymerizable unsaturated group into a sample tube having an inner diameter of 5.0 mm; adding deuterated chloroform ($CDCl_3$) as a solvent to the tube; and dissolving the polyester in a thermostat at 40.0° C.

The $^1$H-NMR spectrum of the sample is measured and peak information to be assigned to the following units is acquired.

(1) A unit Y1 derived from a compound having a polymerizable unsaturated group (2) A unit Y2 derived from a diol free of any polymerizable unsaturated group (3) A unit Y3 derived from a dicarboxylic acid free of any polymerizable unsaturated group The compound having a polymerizable unsaturated group includes the diol having a polymerizable unsaturated group, the dicarboxylic acid having a polymerizable unsaturated group, the vinyl-based compound having a hydroxyl group, and the vinyl-based compound having an isocyanate group.

An inherent peak P1 that does not coincide with any other unit is selected from peaks to be assigned to the unit Y1, and an integrated value Si of the selected peak P1 is calculated.

An inherent peak P2 that does not coincide with any other unit is selected from peaks to be assigned to the unit Y2, and an integrated value S2 of the selected peak P2 is calculated.

An inherent peak P3 that does not coincide with any other unit is selected from peaks to be assigned to the unit Y3, and an integrated value S3 of the selected peak P3 is calculated.

The average number Xa of polymerizable unsaturated groups in one molecule of the polyester having a polymerizable unsaturated group is determined as described below by using the integrated value S1, the integrated value S2, and the integrated value S3.

$$Xa=\{Mp\times(S1/n1)\}/\{M1\times(S1/n1)+M2\times(S2/n2)+M3\times(S3/n3)\}$$

n1, n2, and n3 represent the numbers of hydrogen atoms in the units Y1, Y2, and Y3, respectively, M1, M2, and M3 represent the molecular weights of the units Y1, Y2, and Y3, respectively, and Mp represents the molecular weight of the polyester having a polymerizable unsaturated group.

<Measurement of Amount of Si in Each of Resin "A" and Resin "B" with Fluorescent X-Ray Analyzer (XRF)>

The amount of Si in each of the resin "A" and the resin "B" is measured with a fluorescent X-ray analyzer (XRF) as described below. Each of the resin "A" and the resin "B" is solidified in a pellet shape, and the amounts of elements ranging from Na to U are directly measured with a wavelength-dispersive fluorescent X-ray analyzer Axios advanced (manufactured by PANalytical) under a He atmosphere by a FP method. The total mass of the detected elements is defined as 100%, and the content (mass %) of Si with respect to the total mass is determined with software UniQuant 5 (ver. 5.49).

<Method of Measuring Amount of Si Derived from Organopolysiloxane Structure by X-Ray Photoelectron Spectroscopy (ESCA)>

In the present invention, the amount of Si derived from the organopolysiloxane structure present in the surface of the toner particle is calculated by surface composition analysis based on ESCA. An apparatus and measurement conditions for the ESCA are as described below. Apparatus used: Quantum 2000, manufactured by ULVAC-PHI, Inc.

Analysis method: narrow analysis
Measurement conditions:
X-ray source: Al-Kα
X-ray condition: 100 μm, 25 W, 15 kV
Photoelectron acceptance angle: 45°
PassEnergy: 58.70 eV
Measurement range: ϕ100 μm Measurement is performed under the foregoing conditions, and a peak derived from a C—C bond of a carbon is orbital is corrected to 285 eV. After that, the amount of Si derived from the organopolysiloxane structure with respect to the total amount of constituent elements is calculated from the peak area of a SiO bond of a silicon 2p orbital whose peak top is detected at 100 eV or more and 103 eV or less with a relative sensitivity factor provided by ULVAC-PHI, Incorporated. When any other peak ($SiO_2$: more than 103 eV and 105 eV or less) of the Si 2p orbital is detected, the peak area of the SiO bond is calculated by subjecting the peak of the SiO bond to waveform separation.

<Method of Measuring Melting Point of Each of Crystalline Polyester, Block Polymer, and Wax>

The melting point of each of the crystalline polyester, the block polymer, and the wax is measured with DSC Q2000 (manufactured by TA Instruments) under the following conditions.

| | |
|---|---|
| Rate of temperature increase: | 10° C./min |
| Measurement-starting temperature: | 20° C. |
| Measurement-ending temperature: | 180° C. |

The melting points of indium and zinc are used in the temperature correction of the detecting portion of the apparatus, and the heat of fusion of indium is used in the correction of a heat quantity.

Specifically, about 2 mg of the sample is precisely weighed, loaded into a pan made of aluminum, and subjected to measurement once. An empty pan made of aluminum is used as a reference. The measurement is performed by increasing the temperature of the sample to 200° C. once, subsequently decreasing the temperature to 20° C., and then increasing the temperature again. The peak temperatures of the highest endothermic peak of a DSC curve in the temperature range of from 20° C. to 200° C. in the first temperature increase process in the cases of the crystalline polyester and the block polymer, and in the second temperature increase process in the case of the wax are defined as the melting points of the crystalline polyester, the block polymer, and the wax, respectively. Each of the rate of temperature increase and the rate of temperature decrease is 10° C./min.

<Methods of Measuring Number-Average Molecular Weight (Mn) and Weight-Average Molecular Weight (Mw)>

The molecular weight (Mn, Mw) of the tetrahydrofuran (THF) soluble matter of each of the resins is measured by gel permeation chromatography (GPC) as described below.

First, a sample is dissolved in THF at room temperature over 24 hours. Then, the resultant solution is filtered with a solvent-resistant membrane filter "Myshoridisk" (manufactured by Tosoh Corporation) having a pore diameter of 0.2 μm to provide a sample solution. The concentration of a THF-soluble component in the sample solution is adjusted to about 0.8 mass %. Measurement is performed with the sample solution under the following conditions.

Apparatus: HLC 8120 GPC (detector: RI) (manufactured by Tosoh Corporation)

Column: Septuplicate of Shodex KF-801, 802, 803, 804, 805, 806, and 807 (manufactured by Showa Denko K.K.)

Eluent: tetrahydrofuran (THF)

Flow rate: 1.0 ml/min

Oven temperature: 40.0° C.

Sample injection amount: 0.10 ml

In the calculation of the molecular weight of the sample, a molecular weight calibration curve prepared with standard polystyrene (trade names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

<Methods of Measuring Particle Diameters of Wax Fine Particles and Colorant Fine Particles>

In the present invention, the particle diameters of fine particles are measured with a Microtrac particle size distribution-measuring apparatus HRA (X-100) (manufactured by Nikkiso Co., Ltd.) in the preset range of from 0.001 μm to 10 μm, and are measured as volume-average particle diameters (μm or nm). Water is selected as a diluent solvent.

<Method of Measuring Number-Average Particle Diameter of Resin Fine Particles>

The number-average particle diameter of the resin fine particles is measured with Zeta Sizer Nano-ZS (manufactured by Malvern Instruments Ltd.). First, samples are prepared as described below. Dispersion liquids of the resin fine particles to be measured in an organic solvent are each diluted and adjusted so as to have a solid-liquid ratio of 0.10 mass % (±0.02 mass %), and are each collected in a quartz cell and loaded into a measuring portion. The refractive index of each of the resin fine particles, and the refractive index and viscosity of the dispersion solvent are input as measurement conditions, and the measurement is performed.

EXAMPLES

The present invention is more specifically described below by way of Production Examples and Examples. However, the present invention is by no means limited by Production Examples and Examples.

<Synthesis of Polyester (E1) Having Polymerizable Unsaturated Group>

The following raw materials were loaded into a two-necked flask that had been heated and dried while nitrogen was introduced into the flask.

| | |
|---|---|
| Sebacic acid | 128.0 parts by mass |
| Fumaric acid | 2.6 parts by mass |
| 1,6-Hexanediol | 78.5 parts by mass |
| Dibutyltin oxide | 0.1 part by mass |

The system was purged with nitrogen by a decompression operation, and then the mixture was stirred at 180° C. for 6 hours. After that, while the stirring was continued, the internal temperature of the system was gradually increased to 230° C. under reduced pressure, and was held at the temperature for 2 hours. When the mixture was brought into a viscous state, a reaction was stopped by cooling the mixture with air. Thus, a polyester (E1) having a polymerizable unsaturated group was synthesized. The melting point, Mn, and Mw of E1 were 56° C., 19,000, and 44,000, respectively. The average number of polymerizable unsaturated groups in one molecule of the polyester was 2.0.

<Synthesis of Polyesters (E2) to (E4) Each Having Polymerizable Unsaturated Group>

Polyesters (E2) to (E4) each having a polymerizable unsaturated group were each synthesized in exactly the same manner as in the synthesis of the polyester (E1) having a polymerizable unsaturated group except that the addition amounts of the raw materials to be used were changed as shown in Table 1.

TABLE 1

| — | Raw material and addition amount (part(s) by mass) | | | | Average number of polymerizable unsaturated groups in one molecule | Melting point (° C.) | Mn | Mw |
|---|---|---|---|---|---|---|---|---|
| | Sebacic acid | Fumaric acid | 1,6-Hexanediol | Dibutyltin oxide | | | | |
| Polyester (E1) having polymerizable unsaturated group | 128.0 | 2.6 | 78.5 | 0.1 | 2.0 | 56 | 19,000 | 44,000 |
| Polyester (E2) having polymerizable unsaturated group | 128.0 | 2.0 | 78.0 | 0.1 | 1.5 | 58 | 18,000 | 32,000 |
| Polyester (E3) having polymerizable unsaturated group | 129.5 | 4.1 | 81.1 | 0.1 | 3.0 | 50 | 18,000 | 33,000 |
| Polyester (E4) having polymerizable unsaturated group | 129.6 | 8.0 | 85.9 | 0.1 | 3.5 | 50 | 12,000 | 27,000 |

<Preparation of Organopolysiloxane Compound Having a Vinyl Group (S1)>

A commercially available one-terminal vinyl-modified organopolysiloxane was prepared and used as an organopolysiloxane compound having a vinyl group (S1). The structure of the organopolysiloxane compound having a vinyl group (S1) is represented by the following formula (II), and details about $R^2$ to $R^5$ and the value for a polymerization degree n are shown in Table 2.

Formula (II)

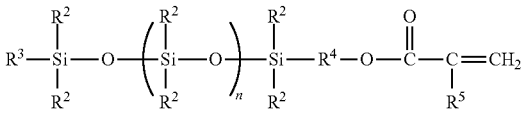

TABLE 2

| — | Product name | Manufacturer name | Molecular weight | $R^2$ | $R^3$ | $R^4$ | $R^5$ | Polymerization degree n |
|---|---|---|---|---|---|---|---|---|
| Organopolysiloxane compound having vinyl group (S1) | X-22-2475 | Shin-Etsu Chemical Co., Ltd. | 420 | Methyl group | Methyl group | Propylene group | Methyl group | 3 |

<Preparation of Polyfunctional Monomers (z1) to (z4)>

Commercially available polyfunctional monomers were prepared and used as polyfunctional monomers (z1) to (z4). The structures of the polyfunctional monomers (z1) to (z4) are each represented by the following formula (III), and the sum of polymerization degrees m and n is shown in Table 3. The polyfunctional monomers correspond to the monomer "a" and the monomer "b", and the number of polymerizable unsaturated groups in one molecule of each of the monomers is two.

Formula (III)

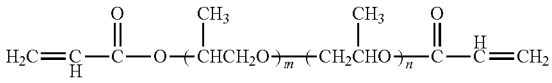

TABLE 3

| | Product name | Manufacturer name | Molecular weight | m + n |
|---|---|---|---|---|
| Polyfunctional monomer (z1) | APG400 | Shin-Nakamura Chemical Co., Ltd. | 536 | 7 |
| Polyfunctional monomer (z2) | APG100 | Shin-Nakamura Chemical Co., Ltd. | 242 | 2 |

TABLE 3-continued

| | Product name | Manufacturer name | Molecular weight | m + n |
|---|---|---|---|---|
| Polyfunctional monomer (z3) | APG200 | Shin-Nakamura Chemical Co., Ltd. | 300 | 3 |
| Polyfunctional monomer (z4) | APG700 | Shin-Nakamura Chemical Co., Ltd. | 808 | 11 |

<Preparation of Resin Fine Particle Dispersion Liquid 1>

The following raw materials for forming a resin and 800.0 parts by mass of toluene were loaded into a two-necked flask that had been heated and dried while nitrogen was introduced into the flask. The materials were heated to 70° C. to be completely dissolved. Thus, a monomer composition 1 was prepared.

| | |
|---|---|
| Polyester (E1) having a polymerizable unsaturated group | 40.0 parts by mass |
| Organopolysiloxane compound having a vinyl group (S1) | 45.0 parts by mass |
| Stylene (St) | 5.0 parts by mass |
| Methacrylic acid (MAA) | 10.0 parts by mass |
| Polyfunctional monomer (z1) | 5.0 parts by mass |

While the monomer composition 1 was stirred at 250 rpm, the temperature thereof was decreased to 25° C., and the composition was subjected to nitrogen bubbling for 30 minutes. After that, the composition was mixed with 0.6 part by mass of azobismethoxydimethylvaleronitrile serving as a polymerization initiator. After that, the mixture was heated at 75° C. and subjected to a reaction for 6 hours. Further, the mixture was heated to 80° C. and subjected to a reaction for 1 hour. After that, the resultant was cooled with air to provide a dispersion of a particulate resin.

The resultant dispersion of the coarse particulate resin was loaded into a stirring tank whose temperature could be regulated, and was transferred to CLEAR SS5 (manufactured by M Technique Co., Ltd.) with a pump at a flow rate of 35 g/min to be treated. Thus, a dispersion of a fine particulate resin was obtained. Conditions for the treatment of the dispersion with the CLEAR SS5 were as follows: the peripheral speed of the outermost peripheral portion of the rotating ring-shaped disc of the CLEAR SS5 was set to 15.7 m/s, and a gap between the rotating ring-shaped disc and a fixed ring-shaped disc was set to 1.6 μm. In addition, the temperature of the stirring tank was regulated so that a liquid temperature after the treatment with the CLEAR SS5 became 40° C. or less.

The resin fine particles and toluene in the dispersion were separated from each other with a centrifugal separator. Conditions for the centrifugal separation are described below.

Centrifuge: H-9R (manufactured by KOKUSAN Corporation)

Rotor: $B_{N1}$ rotor (manufactured by KOKUSAN Corporation)

| | |
|---|---|
| Preset temperature in apparatus: | 4° C. |
| Number of rotations: | 16,500 rpm |
| Time: | 2.5 hours |

After that, a supernatant was removed. Thus, a concentrated dispersion of the fine particulate resin was obtained.

Into a beaker with a stirring apparatus, the concentrated dispersion of the fine particulate resin and acetone were loaded to disperse the fine particulate resin in acetone with a high-power homogenizer (VCX-750). After that, acetone was further added to the resultant. Thus, a resin fine particle dispersion liquid 1 having a solid content concentration of 10 mass % was prepared. The number-average particle diameter of the resin fine particles in the resin fine particle dispersion liquid 1 thus prepared was 0.11 μm. In addition, part of the resin fine particle dispersion liquid 1 was removed, and was dried and solidified. An amount Z of Si in the resultant resin measured by fluorescent X-ray analysis (XRF) was 43.3 mass %. In addition, a crosslink density [(X−1.0)×Y] of the resin determined by calculation was $1.0\times10^{-4}$ (mol/g), and a ratio E/S of a mass E of the polyester having a polymerizable unsaturated group to a mass S of the organopolysiloxane compound having a vinyl group was 0.9.

<Preparation of Resin Fine Particle Dispersion Liquids 2 to 25>

Resin fine particle dispersion liquids 2 to 25 were obtained by changing, in the preparation of the resin fine particle dispersion liquid 1, the addition amounts of the polyester having a polymerizable unsaturated group, the organopolysiloxane compound having a vinyl group, the polyfunctional monomer, and the other monomers to those shown in Table 4. The number-average particle diameter of the resin fine particles in each of the resultant resin fine particle dispersion liquids 2 to 25, the amount Z of Si in a resin in each of the liquids measured by fluorescent X-ray analysis (XRF), the crosslink density [(X−1.0)×Y] of the resin determined by calculation, and the ratio E/S of the mass E of the polyester having a polymerizable unsaturated group to the mass S of the organopolysiloxane compound having a vinyl group are shown in Table 4.

TABLE 4

| Resin fine particle dispersion liquid | Organopolysiloxane compound having vinyl group | | Polyester having polymerizable unsaturated group | | Polyfunctional monomer | | Other monomer St | Other monomer MAA | | | | Number-average particle diameter Dn (μm) |
|---|---|---|---|---|---|---|---|---|---|---|---|---|
| | Kind | Part(s) by mass | Kind | Part(s) by mass | Kind | Part(s) by mass | (part(s) by mass) | (part(s) by mass) | (X − 1.0) × Y | Z (mass %) | E/S | |
| 1 | S1 | 45.0 | E1 | 40.0 | z1 | 5.0 | 5.0 | 10.0 | $1.0 \times 10^{-4}$ | 43.3 | 0.9 | 0.11 |
| 2 | S1 | 25.0 | E1 | 53.0 | z1 | 5.0 | 12.0 | 10.0 | $1.1 \times 10^{-4}$ | 23.8 | 2.1 | 0.11 |
| 3 | S1 | 28.0 | E1 | 50.0 | z1 | 5.0 | 12.0 | 10.0 | $1.0 \times 10^{-4}$ | 26.7 | 1.8 | 0.11 |
| 4 | S1 | 35.0 | E1 | 50.0 | z1 | 5.0 | 5.0 | 10.0 | $1.1 \times 10^{-4}$ | 28.6 | 1.4 | 0.11 |
| 5 | S1 | 51.0 | E1 | 34.0 | z1 | 5.0 | 5.0 | 10.0 | $1.0 \times 10^{-4}$ | 48.6 | 0.7 | 0.11 |
| 6 | S1 | 56.0 | E1 | 29.0 | z1 | 5.0 | 5.0 | 10.0 | $9.8 \times 10^{-5}$ | 53.3 | 0.5 | 0.11 |
| 7 | S1 | 60.0 | E1 | 25.0 | z1 | 5.0 | 5.0 | 10.0 | $9.7 \times 10^{-5}$ | 57.1 | 0.4 | 0.11 |
| 8 | S1 | 45.0 | E1 | 40.0 | z4 | 1.0 | 5.0 | 10.0 | $2.5 \times 10^{-5}$ | 43.3 | 0.9 | 0.15 |
| 9 | S1 | 45.0 | E1 | 40.0 | z4 | 1.5 | 5.0 | 10.0 | $3.1 \times 10^{-5}$ | 43.3 | 0.9 | 0.15 |
| 10 | S1 | 45.0 | E1 | 40.0 | z1 | 2.0 | 5.0 | 10.0 | $5.0 \times 10^{-5}$ | 43.3 | 0.9 | 0.14 |
| 11 | S1 | 45.0 | E1 | 40.0 | z3 | 4.0 | 5.0 | 10.0 | $1.4 \times 10^{-4}$ | 43.3 | 0.9 | 0.13 |
| 12 | S1 | 45.0 | E1 | 40.0 | z2 | 5.0 | 5.0 | 10.0 | $2.1 \times 10^{-4}$ | 43.3 | 0.9 | 0.07 |
| 13 | S1 | 45.0 | E2 | 40.0 | z1 | 5.0 | 5.0 | 10.0 | $9.8 \times 10^{-5}$ | 43.3 | 0.9 | 0.11 |

TABLE 4-continued

| Resin fine particle dispersion liquid | Organopolysiloxane compound having vinyl group Kind | Part(s) by mass | Polyester having polymerizable unsaturated group Kind | Part(s) by mass | Polyfunctional monomer Kind | Part(s) by mass | Other monomer St (part(s) by mass) | MAA (part(s) by mass) | (X − 1.0) × Y | Z (mass %) | E/S | Number-average particle diameter Dn (μm) |
|---|---|---|---|---|---|---|---|---|---|---|---|---|
| 14 | S1 | 45.0 | E3 | 40.0 | z1 | 5.0 | 5.0 | 10.0 | $1.1 \times 10^{-4}$ | 43.3 | 0.9 | 0.11 |
| 15 | S1 | 45.0 | E4 | 40.0 | z1 | 5.0 | 5.0 | 10.0 | $1.2 \times 10^{-4}$ | 43.3 | 0.9 | 0.10 |
| 16 | S1 | 25.0 | E1 | 40.0 | z1 | 3.0 | 25.0 | 10.0 | $6.7 \times 10^{-5}$ | 24.5 | 1.6 | 0.13 |
| 17 | S1 | 25.0 | E1 | 40.0 | z1 | 2.0 | 25.0 | 10.0 | $5.0 \times 10^{-5}$ | 24.5 | 1.6 | 0.14 |
| 18 | S1 | 18.0 | E1 | 47.0 | z1 | 3.0 | 25.0 | 10.0 | $6.9 \times 10^{-5}$ | 17.6 | 2.6 | 0.13 |
| 19 | S1 | 20.0 | E1 | 45.0 | z1 | 3.0 | 25.0 | 10.0 | $6.8 \times 10^{-5}$ | 19.6 | 2.3 | 0.13 |
| 20 | S1 | 30.0 | E1 | 30.0 | z1 | 3.0 | 30.0 | 10.0 | $6.3 \times 10^{-5}$ | 28.8 | 1.0 | 0.13 |
| 21 | S1 | 35.0 | E1 | 30.0 | z1 | 3.0 | 25.0 | 10.0 | $6.3 \times 10^{-5}$ | 34.3 | 0.9 | 0.13 |
| 22 | S1 | 25.0 | E2 | 40.0 | z1 | 3.0 | 25.0 | 10.0 | $6.1 \times 10^{-5}$ | 24.5 | 1.6 | 0.13 |
| 23 | S1 | 25.0 | E3 | 40.0 | z1 | 3.0 | 25.0 | 10.0 | $8.0 \times 10^{-5}$ | 24.5 | 1.6 | 0.13 |
| 24 | S1 | 25.0 | E4 | 40.0 | z1 | 3.0 | 25.0 | 10.0 | $8.7 \times 10^{-5}$ | 24.5 | 1.6 | 0.13 |
| 25 | S1 | 25.0 | E1 | 40.0 | — | — | 25.0 | 10.0 | $1.3 \times 10^{-5}$ | 24.5 | 1.6 | 0.15 |

<Synthesis of Crystalline Polyester 1>

The following raw materials were loaded into a two-necked flask that had been heated and dried while nitrogen was introduced into the flask.

| | |
|---|---|
| Sebacic acid | 123.0 parts by mass |
| 1,6-Hexanediol | 76.0 parts by mass |
| Dibutyltin oxide | 0.1 part by mass |

The system was purged with nitrogen by a decompression operation, and then the mixture was stirred at 180° C. for 6 hours. After that, while the stirring was continued, the internal temperature of the system was gradually increased to 230° C. under reduced pressure, and was held at the temperature for 2 hours. When the mixture was brought into a viscous state, a reaction was stopped by cooling the mixture with air. Thus, a crystalline polyester 1 was synthesized. The melting point, Mn, and Mw of the crystalline polyester 1 were 73° C., 5,800, and 11,800, respectively.

<Synthesis of Block Polymer 1>

| | |
|---|---|
| Crystalline polyester 1 | 210.0 parts by mass |
| m-Xylylene diisocyanate (XDI) | 56.0 parts by mass |
| Cyclohexane dimethanol (CHDM) | 34.0 parts by mass |
| Tetrahydrofuran (THF) | 300.0 parts by mass |

The foregoing materials were loaded into a reaction vessel including a stirring apparatus and a temperature gauge while the vessel was purged with nitrogen. The mixture was heated to 50° C. and subjected to a urethanization reaction over 15 hours. THF serving as a solvent was distilled off. Thus, a block polymer 1 was obtained. The melting point, Mn, and Mw of the block polymer 1 were 65° C., 16,500, and 33,500, respectively.

<Preparation of Block Polymer Solution 1>

128.0 Parts by mass of acetone serving as an organic solvent and 72.0 parts by mass of the block polymer 1 were loaded into a beaker with a stirring apparatus. The mixture was heated to 50° C., and was continuously stirred until the polymer was completely dissolved. Thus, a block polymer solution 1 having a solid content of 36.0 mass % was prepared.

<Preparation of Colorant Dispersion Liquid 1>

| | |
|---|---|
| C.I. Pigment Blue 15:3 | 100.0 parts by mass |
| Acetone | 150.0 parts by mass |
| Glass beads (1 mm) | 300.0 parts by mass |

The foregoing materials were loaded into a heat-resistant glass container, and were dispersed with PAINT SHAKER (manufactured by Toyo Seiki Seisaku-Sho, Ltd.) for 5 hours, followed by the removal of glass beads with a nylon mesh. Thus, a colorant dispersion liquid 1 having a volume-average particle diameter of 200 nm and a solid content of 40.0 mass % was obtained.

<Preparation of Wax Dispersion Liquid 1>

| | |
|---|---|
| Dipentaerythritol palmitate ester wax | 16.0 parts by mass |
| Wax dispersant (copolymer having a peak molecular weight of 8,500 prepared by subjecting 50.0 parts by mass of styrene, 25.0 parts by mass of n-butyl acrylate, and 10.0 parts by mass of acrylonitrile to graft copolymerization in the presence of 15.0 parts by mass of polyethylene) | 8.0 parts by mass |
| Acetone | 76.0 parts by mass |

The foregoing materials were loaded into a glass beaker with a stirring blade (manufactured by Iwaki Glass Co., Ltd.), and the wax was dissolved in acetone by heating air in the system to 50° C.

Next, the mixture in the system was gradually cooled while being gently stirred under the condition of 50 rpm. The mixture was cooled to 25° C. over 3 hours to provide a milky-white liquid.

The solution was loaded into a heat-resistant glass container together with 20.0 parts by mass of glass beads each having a diameter of 1 mm, and the materials were dispersed with PAINT SHAKER for 3 hours, followed by the removal of the glass beads with a nylon mesh. Thus, a wax dispersion liquid 1 having a volume-average particle diameter of 270 nm and a solid content of 24.0 mass % was obtained.

Production of Toner Particles of Two-Layer Type Formed of Core, Intermediate Layer, and Shell Layer Example 1

In an apparatus illustrated in FIG. 1, first, valves V1, V2, and V3 and a pressure-adjusting valve V4 were closed. 18.0 Parts by mass of the resin fine particle dispersion liquid 16 for forming an intermediate layer containing the resin "B" was loaded into a pressure-resistant granulation tank T1 including a filter for capturing toner particle and a stirring mechanism, and the internal temperature of the tank was adjusted to 40° C. Next, the valve V1 was opened, carbon dioxide (purity: 99.99%) was introduced from a carbon dioxide bomb B1 into the granulation tank T1 with a pump P1, and the valve V1 was closed when the internal pressure of the tank reached 2.0 MPa.

Meanwhile, the block polymer solution 1, the colorant dispersion liquid 1, and the wax dispersion liquid 1 were loaded into a resin solution tank T3 to prepare a resin solution, and then the internal temperature of the tank was adjusted to 40° C. Next, the valve V3 was opened, and the resin solution of the resin solution tank T3 was introduced into the granulation tank T1 with a pump P3 while the inside of the granulation tank T1 was stirred at 2,000 rpm. Then, at the time of the completion of the introduction of the entirety of the resin solution, the valve V3 was closed. The internal pressure of the granulation tank T1 after the introduction became 3.0 MPa. The mass of the entirety of the introduced carbon dioxide measured with a mass flowmeter was 280.0 parts by mass.

The amounts (part(s) by mass) of the materials to be loaded into the resin solution tank T3 are as described below.

| | |
|---|---|
| Block polymer solution 1 | 100.0 parts by mass |
| Wax dispersion liquid 1 | 10.0 parts by mass |
| Colorant dispersion liquid 1 | 6.0 parts by mass |

After the introduction of the contents in the resin solution tank T3 into the granulation tank T1 had been terminated, the formation of a dispersion based on the droplets of the resin solution was performed by further stirring the contents at 2,000 rpm for 3 minutes.

Next, 10.8 parts by mass of the resin fine particle dispersion liquid 1 for forming a shell layer containing the resin "A" was loaded into a resin fine particle dispersion liquid tank T2, and then the internal temperature of the tank was adjusted to 40° C. Next, the valve V2 was opened, and the resin fine particle dispersion liquid 1 of the resin fine particle dispersion liquid tank T2 was introduced into the granulation tank T1 with a pump P2 while the inside of the granulation tank T1 was stirred at 2,000 rpm. Then, at the time of the completion of the introduction of the entirety of the resin fine particle dispersion liquid 1, the valve V2 was closed. The internal pressure of the granulation tank T1 after the introduction became 3.1 MPa.

Next, the valve V1 was opened, and carbon dioxide was introduced into the granulation tank T1 from the carbon dioxide bomb B1 with the pump P1. The valve V1 was closed when the internal pressure of the tank reached 10.0 MPa. Thus, the extraction of acetone in each of the droplets in the dispersion into the dispersion medium was performed.

After that, the valve V1 and the pressure-adjusting valve V4 were opened, and carbon dioxide was further flowed with the pump P1 while the internal pressure of the granulation tank T1 was held at 10.0 MPa. Through the foregoing operation, carbon dioxide containing extracted acetone serving as an organic solvent was discharged to an organic solvent recovery tank T4, and acetone and carbon dioxide were separated from each other.

In addition, after the discharge of carbon dioxide to the organic solvent recovery tank T4 had been started, acetone in the organic solvent recovery tank T4 was removed every 5 minutes. The operation was continued until acetone did not accumulate in the organic solvent recovery tank T4 and hence could not be removed. Desolvation was terminated at the time point when acetone was not removed any longer, and the valve V1 and the pressure-adjusting valve V4 were closed to terminate the flow of carbon dioxide.

Further, the pressure-adjusting valve V4 was opened to perform depressurization in the granulation tank T1 to atmospheric pressure. Thus, toner particle 1 captured by the filter was recovered.

Examples 2 to 27 and Comparative Examples 1 to 3

Toner particles 2 to 27 and 30 to 32 were obtained in exactly the same manner as in Example 1 except that in Example 1, the resin fine particle dispersion liquids 2 to 25 were used instead of the resin fine particle dispersion liquid 1 for forming an intermediate layer and the resin fine particle dispersion liquid 16 for forming a shell layer. The physical properties of the resultant toner particle 2 to 27 and 30 to 32 are shown in Table 5.

Production of Toner Particle of Multilayer Type Formed of Core, Plurality of Intermediate Layers, and Shell Layer Example 28

In an apparatus illustrated in FIG. 1, first, valves V1, V2, and V3 and a pressure-adjusting valve V4 were closed. Then, 18.0 parts by mass of the resin fine particle dispersion liquid 16 for forming a first intermediate layer containing the resin "B" was loaded into a pressure-resistant granulation tank T1 including a filter for capturing toner particle and a stirring mechanism, and the internal temperature of the tank was adjusted to 40° C. Next, the valve V1 was opened, carbon dioxide (purity: 99.99%) was introduced from a carbon dioxide bomb B1 into the granulation tank T1 with a pump P1, and the valve V1 was closed when the internal pressure of the tank reached 2.0 MPa.

Meanwhile, the block polymer solution 1, the colorant dispersion liquid 1, and the wax dispersion liquid 1 were loaded into a resin solution tank T3 to prepare a resin solution, and then the internal temperature of the tank was adjusted to 40° C. Next, the valve V3 was opened, and the resin solution of the resin solution tank T3 was introduced into the granulation tank T1 with a pump P3 while the inside of the granulation tank T1 was stirred at 2,000 rpm. Then, at the time of the completion of the introduction of the entirety of the resin solution, the valve V3 was closed. The internal pressure of the granulation tank T1 after the introduction became 3.0 MPa. The mass of the entirety of the introduced carbon dioxide measured with a mass flowmeter was 280.0 parts by mass.

The amounts (part(s) by mass) of the materials to be loaded into the resin solution tank T3 are as described below.

| | |
|---|---|
| Block polymer solution 1 | 100.0 parts by mass |
| Wax dispersion liquid 1 | 10.0 parts by mass |
| Colorant dispersion liquid 1 | 6.0 parts by mass |

Next, 10.8 parts by mass of the resin fine particle dispersion liquid 20 for forming a second intermediate layer was loaded into the resin fine particle dispersion liquid tank T2, and then the internal temperature of the tank was adjusted to 40° C. The valve V2 was opened, and the resin fine particle dispersion liquid 20 of the resin fine particle dispersion liquid tank T2 was introduced into the granulation tank T1 with the pump P2 while the inside of the granulation tank T1 was stirred at 2,000 rpm. Then, at the time of the completion of the introduction of the entirety of the resin fine particle dispersion liquid 20, the valve V2 was closed. The internal pressure of the granulation tank T1 after the introduction became 3.1 MPa.

Next, 10.8 parts by mass of the resin fine particle dispersion liquid 1 for forming a shell layer containing the resin "A" was loaded into the resin fine particle dispersion liquid tank T2, and then the internal temperature of the tank was adjusted to 40° C. The valve V2 was opened, and the resin fine particle dispersion liquid 1 of the resin fine particle dispersion liquid tank T2 was introduced into the granulation tank T1 with the pump P2 while the inside of the granulation tank T1 was stirred at 2,000 rpm. Then, at the time of the completion of the introduction of the entirety of the resin fine particle dispersion liquid 1, the valve V2 was closed. The internal pressure of the granulation tank T1 after the introduction became 3.2 MPa.

In steps subsequent to the foregoing steps, toner particle 28 was recovered by performing desolvation and depressurization in the same manner as in the method of producing the toner particle 1.

Production of Toner Particles of Monolayer Type Formed of Core and Shell Layer

Example 29

In an apparatus illustrated in FIG. 1, first, valves V1, V2, and V3 and a pressure-adjusting valve V4 were closed. Then, 18.0 parts by mass of the resin fine particle dispersion liquid 12 for forming a shell layer containing the resin "A" was loaded into a pressure-resistant granulation tank T1 including a filter for capturing toner particle and a stirring mechanism, and the internal temperature of the tank was adjusted to 40° C. Next, the valve V1 was opened, carbon dioxide (purity: 99.99%) was introduced from a carbon dioxide bomb B1 into the granulation tank T1 with a pump P1, and the valve V1 was closed when the internal pressure of the tank reached 2.0 MPa.

Meanwhile, the block polymer solution 1, the colorant dispersion liquid 1, and the wax dispersion liquid 1 were loaded into a resin solution tank T3 to prepare a resin solution, and then the internal temperature of the tank was adjusted to 40° C. Next, the valve V3 was opened, and the resin solution of the resin solution tank T3 was introduced into the granulation tank T1 with a pump P3 while the inside of the granulation tank T1 was stirred at 2,000 rpm. Then, at the time of the completion of the introduction of the entirety of the resin solution, the valve V3 was closed. The internal pressure of the granulation tank T1 after the introduction became 3.0 MPa. The mass of the entirety of the introduced carbon dioxide measured with a mass flowmeter was 280.0 parts by mass.

The amounts (part(s) by mass) of the materials to be loaded into the resin solution tank T3 are as described below.

| | |
|---|---|
| Block polymer solution 1 | 100.0 parts by mass |
| Wax dispersion liquid 1 | 10.0 parts by mass |
| Colorant dispersion liquid 1 | 6.0 parts by mass |

After the completion of the introduction of the contents of the resin solution tank T3 into the granulation tank T1, the contents were further stirred at 2,000 rpm for 3 minutes to form a dispersion based on the droplets of the resin solution.

In steps subsequent to the foregoing steps, toner particle 29 was recovered by performing desolvation and depressurization in the same manner as in the method of producing the toner particle 1.

Comparative Example 4

Toner particle 33 was recovered in exactly the same manner as in Example 29 except that in Example 29, the resin fine particle dispersion liquid 25 was used instead of the resin fine particle dispersion liquid 16 for forming a shell layer containing the resin "A".

<Preparation of Toners 1 to 33>

100 Parts by mass of the toner particle 1 was subjected to dry mixing with 1.8 parts by mass of hydrophobic silica fine powder treated with hexamethyldisilazane (number-average primary particle diameter: 7 nm) and 0.15 part by mass of rutile-type titanium oxide fine powder (number-average primary particle diameter: 30 nm) by using HENSCHEL MIXER (mixer manufactured by Mitsui Miike Chemical Engineering Machinery, Co., Ltd.) for 5 minutes. Thus, a toner 1 was obtained. Toners 2 to 33 were obtained by performing the same operations as that of the toner particle 1 on the toner particles 2 to 33.

[Evaluations of Toner]

<Long-Term Standing Under Severe Environment>

Figure 2:
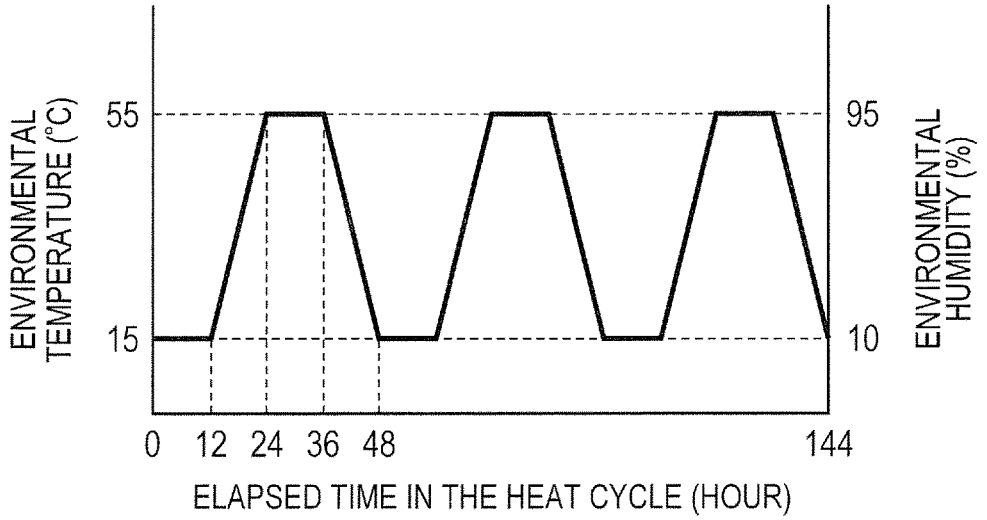
FIG. 2 is a graph for showing the time chart of a heat cycle.

About 100 g of each of the resultant toners 1 to 33 was loaded into a 1,000-milliliter polymer cup, and was left to stand under a low-temperature and low-humidity environment (15° C., 10% RH) for 12 hours. After that, the environment was changed to a high-temperature and high-humidity environment (55° C., 95% RH) over 12 hours. After the toner had been left to stand under the environment for 12 hours, the environment was changed to the low-temperature and low-humidity environment (15° C., 10% RH) over 12 hours again. The foregoing operations were defined as one cycle, and the cycle was repeated three times. After that, the toner was removed and used in evaluations for its environmental stability and durability. The time chart of the heat cycle is shown in FIG. 2.

<Durability>

An evaluation for durability was performed with a commercially available printer LBP9200C manufactured by Canon Inc. The LBP9200C adopts a one-component contact development system and regulates the amount of a toner on a developer carrier with a toner-regulating member. Used as an evaluation cartridge was a cartridge obtained by removing a toner in a commercially available cartridge, cleaning the inside of the cartridge through air blowing, and then loading 260 g of any one of the toners into the cartridge. The evaluation was performed by mounting the cartridge on a cyan station and mounting a dummy cartridge on any other station.

An image having a print percentage of 1% was continuously output under a low-temperature and low-humidity environment at 15° C. and 10% RH. Every time the image was output on 1,000 sheets, a solid image and a halftone image were output, and the presence or absence of the occurrence of a vertical stripe resulting from the melt adhesion of the toner to the toner regulating member, i.e., the so-called development stripe was visually observed. Finally, image output was performed on 20,000 sheets. The results of the evaluations are shown in Table 6.

[Evaluation Criteria]

A: no occurrence of development stripe even after passing of 20,000 sheets

B: occurrence of development stripe after passing of more than 18,000 sheets and 20,000 sheets or less C: occurrence of development stripe after passing of more than 15,000 sheets and 19,000 sheets or less D: occurrence of development stripe after passing of 15,000 sheets or less In the present invention, the toner was judged to have satisfactory durability when its rank was C or higher.

<Environmental Stability>

A difference between charge quantities in a low-temperature and low-humidity (LL) environment, and a high-temperature and high-humidity (HH) environment was evaluated by the following method.

(Sample Preparation)

1.0 Gram of a toner and 19.0 g of a predetermined carrier (standard carrier of The Imaging Society of Japan: spherical carrier N-01 obtained by treating the surface of a ferrite core) are loaded into a plastic bottle having a lid, and are left to stand under each of the LL environment having a temperature of 15° C. and a relative humidity of 10%, and the HH environment having a temperature of 32.0° C. and a relative humidity of 85% for 5 days.

(Charge Quantity Measurement)

Figure 3:
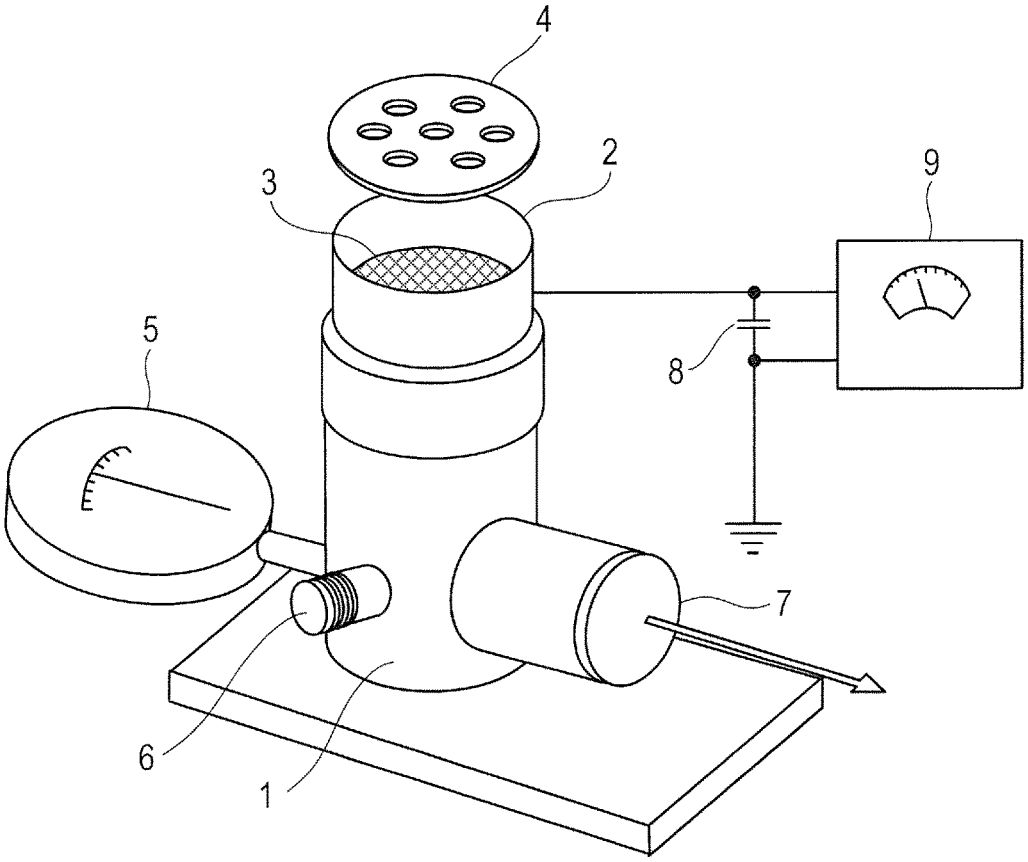
FIG. 3 is a view for illustrating an example of an apparatus for measuring the charge quantity of a toner.

The plastic bottle containing the carrier and the toner is lidded, and is shaken with a shaker (YS-LD, manufactured by Yayoi Co., Ltd.) at a speed of 4 reciprocations per second for 1 minute. Thus, a developer formed of the toner and the carrier is charged. Next, the triboelectric charge quantity of the developer is measured in an apparatus for measuring a triboelectric charge quantity illustrated in FIG. 3. In FIG. 3, 0.5 g or more and 1.5 g or less of the developer is loaded into a metallic measuring container 2 having a screen 3 having an aperture of 20 μm at its bottom, and the container is covered with a metallic lid 4. The mass of the entirety of the measuring container 2 at this time is precisely weighed and defined as W1 (g). Next, the toner is sucked from a suction port 7 in a suction machine 1 (at least its portion in contact with the measuring container 2 is an insulator), and the pressure of a vacuum gauge 5 is set to 2.5 kPa by adjusting an air quantity-regulating valve 6. The toner is sucked and removed by performing the suction in this state for 2 minutes. The potential of an electrometer 9 at this time is defined as V (V). Here, a capacitor 8 has a capacity of C (mF). In addition, the mass of the entirety of the measuring container after the suction is precisely weighed and defined as W2 (g). A triboelectric charge quantity Q (mC/kg) of the sample is calculated from the following equation.

$$\text{Triboelectric charge quantity } Q(\text{mC/kg}) \text{ of sample} = C \times V/(W1 - W2)$$

When the triboelectric charge quantity of the sample immediately after the shaking in the LL environment was defined as Ql (mC/kg), and the triboelectric charge quantity in the HH environment was defined as Qh (mC/kg), a ratio Qh/Ql was used as an indicator of environmental stability.

Further, an image was output on 20,000 sheets with the printer LBP9200C used in the evaluation for durability, and then the toner was removed from the cartridge. The toner was also subjected to the same evaluation to be evaluated for its environmental stability after endurance. The results of the evaluations are shown in Table 6.

[Evaluation Criteria]

A: 0.95 or more

B: 0.90 or more and less than 0.95

C: 0.80 or more and less than 0.90

D: Less than 0.80

In the present invention, the toner was judged to have satisfactory environmental stability when its rank was C or higher.

<Evaluation for Low-temperature Fixability>

A fresh toner that had not been left to stand under a severe environment for a long time period was used in an evaluation for low-temperature fixability.

Two-component developers 1 to 33 were each prepared by mixing 8.0 parts by mass of the corresponding one of the toners 1 to 33 and 92.0 parts by mass of the carrier. Each of the two-component developers 1 to 33 and an evaluation machine obtained by improving a color laser copying machine CLC5000 (manufactured by Canon Inc.) were used in the evaluation. The development contrast of the copying machine was adjusted so that a toner laid-on level on the paper of the CLC5000 became 1.2 mg/cm$^2$, and then a "solid" unfixed image having an end margin of 5 mm, a width of 100 mm, and a length of 280 mm was produced by a monochrome mode under a normal-temperature and normal-humidity environment (23° C., 60% RH). Cardboard A4 paper ("Prober Bond Paper": 105 g/m$^2$, manufactured by Fox River) was used as the paper.

Next, the fixing unit of LBP5900 (manufactured by Canon Inc.) was reconstructed so that its fixation temperature could be manually set, and then the rotational speed of the fixing unit and a pressure in the nip thereof were changed to 270 mm/s and 120 kPa, respectively. Under the normal-temperature and normal-humidity environment (23° C., 60% RH), while the fixation temperature was increased in the range of from 80° C. to 180° C. in increments of 10° C., a fixed image of the "solid" unfixed image at each temperature was obtained with the reconstructed fixing unit.

The image region of the resultant fixed image was covered with soft thin paper (e.g., paper available under the trade name "DUSPER" from Ozu Corporation), and the image region was rubbed in a reciprocating manner 5 times while a load of 4.9 kPa was applied from above the thin paper. Image densities before the rubbing and after the rubbing were measured, and an image density reduction ratio ΔD (%) was calculated from the following equation. The temperature at which the ΔD (%) was less than 10% was defined as a fixation starting temperature, and the low-temperature fixability was evaluated by such evaluation criteria as described below.

The image densities were measured with a color reflection densitometer (Color reflection densitometer X-Rite 404A: manufacturer: X-Rite).

$$\Delta D\ (\%) = (\text{image density before rubbing} - \text{image density after rubbing})/\text{image density before rubbing} \times 100 \quad \text{(Equation):}$$

(Evaluation Criteria)

A: Fixation starting temperature of 100° C. or less

B: Fixation starting temperature of 110° C.

C: Fixation starting temperature of 120° C.

D: Fixation starting temperature of 130° C.

E: Fixation starting temperature of 140° C. or more

In the present invention, the toner was judged to have satisfactory low-temperature fixability when its rank was C or higher.

TABLE 5

| — | Toner particle | Resin fine particle dispersion liquid of resin "A" Kind | Addition number of parts (Ma) | Resin fine particle dispersion liquid of resin "B" Kind | Addition number of parts (Mb) | Amount of Si of each of toner particle measured by ESCA (atomic %) | (Xa − 1.0) × Ya | (Xb − 1.0) × Yb | Za | Zb | Ea/Sa | Eb/Sb |
|---|---|---|---|---|---|---|---|---|---|---|---|---|
| Example 1 | 1 | Resin fine particle dispersion liquid 1 | 3.0 | Resin fine particle dispersion liquid 16 | 5.0 | 8.7 | $1.0 \times 10^{-4}$ | $6.7 \times 10^{-5}$ | 13.6 | 7.7 | 0.9 | 1.6 |
| Example 2 | 2 | Resin fine particle dispersion liquid 3 | 3.0 | Resin fine particle dispersion liquid 16 | 5.0 | 6.2 | $1.0 \times 10^{-4}$ | $6.7 \times 10^{-5}$ | 8.4 | 7.7 | 1.8 | 1.6 |
| Example 3 | 3 | Resin fine particle dispersion liquid 4 | 3.0 | Resin fine particle dispersion liquid 16 | 5.0 | 6.8 | $1.1 \times 10^{-4}$ | $6.7 \times 10^{-5}$ | 9.0 | 7.7 | 1.4 | 1.6 |
| Example 4 | 4 | Resin fine particle dispersion liquid 5 | 3.0 | Resin fine particle dispersion liquid 16 | 5.0 | 9.4 | $1.0 \times 10^{-4}$ | $6.7 \times 10^{-5}$ | 15.3 | 7.7 | 0.7 | 1.6 |
| Example 5 | 5 | Resin fine particle dispersion liquid 6 | 3.0 | Resin fine particle dispersion liquid 16 | 5.0 | 9.9 | $9.8 \times 10^{-5}$ | $6.7 \times 10^{-5}$ | 16.7 | 7.7 | 0.5 | 1.6 |
| Example 6 | 6 | Resin fine particle dispersion liquid 9 | 3.0 | Resin fine particle dispersion liquid 17 | 5.0 | 8.7 | $3.1 \times 10^{-5}$ | $5.0 \times 10^{-5}$ | 13.6 | 7.7 | 0.9 | 1.6 |
| Example 7 | 7 | Resin fine particle dispersion liquid 10 | 3.0 | Resin fine particle dispersion liquid 17 | 5.0 | 8.7 | $5.0 \times 10^{-5}$ | $5.0 \times 10^{-5}$ | 13.6 | 7.7 | 0.9 | 1.6 |
| Example 8 | 8 | Resin fine particle dispersion liquid 11 | 3.0 | Resin fine particle dispersion liquid 16 | 5.0 | 8.7 | $1.4 \times 10^{-4}$ | $6.7 \times 10^{-5}$ | 13.6 | 7.7 | 0.9 | 1.6 |
| Example 9 | 9 | Resin fine particle dispersion liquid 12 | 3.0 | Resin fine particle dispersion liquid 16 | 5.0 | 8.7 | $2.1 \times 10^{-4}$ | $6.7 \times 10^{-5}$ | 13.6 | 7.7 | 0.9 | 1.6 |
| Example 10 | 10 | Resin fine particle dispersion liquid 13 | 3.0 | Resin fine particle dispersion liquid 16 | 5.0 | 8.7 | $9.8 \times 10^{-5}$ | $6.7 \times 10^{-5}$ | 13.6 | 7.7 | 0.9 | 1.6 |
| Example 11 | 11 | Resin fine particle dispersion liquid 14 | 3.0 | Resin fine particle dispersion liquid 16 | 5.0 | 8.7 | $1.1 \times 10^{-4}$ | $6.7 \times 10^{-5}$ | 13.6 | 7.7 | 0.9 | 1.6 |
| Example 12 | 12 | Resin fine particle dispersion liquid 15 | 3.0 | Resin fine particle dispersion liquid 16 | 5.0 | 8.7 | $1.2 \times 10^{-4}$ | $6.7 \times 10^{-5}$ | 13.6 | 7.7 | 0.9 | 1.6 |
| Example 13 | 13 | Resin fine particle dispersion liquid 1 | 0.5 | Resin fine particle dispersion liquid 16 | 5.0 | 8.7 | $1.0 \times 10^{-4}$ | $6.7 \times 10^{-5}$ | 13.6 | 7.7 | 0.9 | 1.6 |
| Example 14 | 14 | Resin fine particle dispersion liquid 1 | 1.2 | Resin fine particle dispersion liquid 16 | 5.0 | 8.7 | $1.0 \times 10^{-4}$ | $6.7 \times 10^{-5}$ | 13.6 | 7.7 | 0.9 | 1.6 |
| Example 15 | 15 | Resin fine particle dispersion liquid 1 | 4.5 | Resin fine particle dispersion liquid 16 | 5.0 | 8.7 | $1.0 \times 10^{-4}$ | $6.7 \times 10^{-5}$ | 13.6 | 7.7 | 0.9 | 1.6 |
| Example 16 | 16 | Resin fine particle dispersion liquid 1 | 6.0 | Resin fine particle dispersion liquid 16 | 5.0 | 8.7 | $1.0 \times 10^{-4}$ | $6.7 \times 10^{-5}$ | 13.6 | 7.7 | 0.9 | 1.6 |

TABLE 5-continued

| — | Toner particle | Resin fine particle dispersion liquid of resin "A" Kind | Addition number of parts (Ma) | Resin fine particle dispersion liquid of resin "B" Kind | Addition number of parts (Mb) | Amount of Si of each of toner particle measured by ESCA (atomic %) | (Xa − 1.0) × Ya | (Xb − 1.0) × Yb | Za | Zb | Ea/Sa | Eb/Sb |
|---|---|---|---|---|---|---|---|---|---|---|---|---|
| Example 17 | 17 | Resin fine particle dispersion liquid 1 | 3.0 | Resin fine particle dispersion liquid 18 | 5.0 | 8.7 | $1.0 \times 10^{-4}$ | $6.9 \times 10^{-5}$ | 13.6 | 5.5 | 0.9 | 2.6 |
| Example 18 | 18 | Resin fine particle dispersion liquid 1 | 3.0 | Resin fine particle dispersion liquid 19 | 5.0 | 8.7 | $1.0 \times 10^{-4}$ | $6.8 \times 10^{-5}$ | 13.6 | 6.2 | 0.9 | 2.3 |
| Example 19 | 19 | Resin fine particle dispersion liquid 1 | 3.0 | Resin fine particle dispersion liquid 20 | 5.0 | 8.7 | $1.0 \times 10^{-4}$ | $6.3 \times 10^{-5}$ | 13.6 | 9.0 | 0.9 | 1.0 |
| Example 20 | 20 | Resin fine particle dispersion liquid 1 | 3.0 | Resin fine particle dispersion liquid 21 | 5.0 | 8.7 | $1.0 \times 10^{-4}$ | $6.3 \times 10^{-5}$ | 13.6 | 10.8 | 0.9 | 0.9 |
| Example 21 | 21 | Resin fine particle dispersion liquid 1 | 3.0 | Resin fine particle dispersion liquid 22 | 5.0 | 8.7 | $1.0 \times 10^{-4}$ | $6.1 \times 10^{-5}$ | 13.6 | 7.7 | 0.9 | 1.6 |
| Example 22 | 22 | Resin fine particle dispersion liquid 1 | 3.0 | Resin fine particle dispersion liquid 23 | 5.0 | 8.7 | $1.0 \times 10^{-4}$ | $8.0 \times 10^{-5}$ | 13.6 | 7.7 | 0.9 | 1.6 |
| Example 23 | 23 | Resin fine particle dispersion liquid 1 | 3.0 | Resin fine particle dispersion liquid 24 | 5.0 | 8.7 | $1.0 \times 10^{-4}$ | $8.7 \times 10^{-5}$ | 13.6 | 7.7 | 0.9 | 1.6 |
| Example 24 | 24 | Resin fine particle dispersion liquid 1 | 3.0 | Resin fine particle dispersion liquid 16 | 2.0 | 8.7 | $1.0 \times 10^{-4}$ | $6.7 \times 10^{-5}$ | 13.6 | 7.7 | 0.9 | 1.6 |
| Example 25 | 25 | Resin fine particle dispersion liquid 1 | 3.0 | Resin fine particle dispersion liquid 16 | 3.2 | 8.7 | $1.0 \times 10^{-4}$ | $6.7 \times 10^{-5}$ | 13.6 | 7.7 | 0.9 | 1.6 |
| Example 26 | 26 | Resin fine particle dispersion liquid 1 | 3.0 | Resin fine particle dispersion liquid 16 | 9.5 | 8.7 | $1.0 \times 10^{-4}$ | $6.7 \times 10^{-5}$ | 13.6 | 7.7 | 0.9 | 1.6 |
| Example 27 | 27 | Resin fine particle dispersion liquid 1 | 3.0 | Resin fine particle dispersion liquid 16 | 11.0 | 8.7 | $1.0 \times 10^{-4}$ | $6.7 \times 10^{-5}$ | 13.6 | 7.7 | 0.9 | 1.6 |
| Example 28 | 28 | Resin fine particle dispersion liquid 1 | 3.0 | Resin fine particle dispersion liquid 16 | 5.0 | 8.7 | $1.0 \times 10^{-4}$ | $6.7 \times 10^{-5}$ | 13.6 | 7.7 | 0.9 | 1.6 |
| Example 29 | 29 | Resin fine particle dispersion liquid 12 | 5.0 | — | — | 8.7 | $2.1 \times 10^{-4}$ | — | 13.6 | — | 0.9 | — |
| Comparative Example 1 | 30 | Resin fine particle dispersion liquid 2 | 3.0 | Resin fine particle dispersion liquid 16 | 5.0 | 5.7 | $1.1 \times 10^{-4}$ | $6.7 \times 10^{-5}$ | 7.5 | 9.2 | 2.1 | 1.6 |
| Comparative Example 2 | 31 | Resin fine particle dispersion liquid 7 | 3.0 | Resin fine particle dispersion liquid 16 | 5.0 | 10.3 | $9.7 \times 10^{-5}$ | $6.7 \times 10^{-5}$ | 17.9 | 7.7 | 0.4 | 1.6 |
| Comparative Example 3 | 32 | Resin fine particle dispersion liquid 8 | 3.0 | Resin fine particle dispersion liquid 17 | 5.0 | 8.7 | $2.5 \times 10^{-5}$ | $5.0 \times 10^{-5}$ | 13.6 | 7.7 | 0.9 | 1.6 |
| Comparative Example 4 | 33 | Resin fine particle dispersion liquid 25 | 5.0 | — | — | 7.3 | $1.3 \times 10^{-5}$ | — | 7.7 | — | 1.6 | — |

TABLE 6

| — | Environmental stability | | Durability | Low-temperature |
|---|---|---|---|---|
| | Initial stage Qh/Ql | After passing of 20,000 sheets Qh/Ql | Number of sheets passed by the time development stripe occurs (sheets) | fixability (° C.) |
| Example 1 | A (0.98) | A (0.96) | A (No occurrence of development stripe even after passing of 20,000 sheets) | A (100) |
| Example 2 | C (0.88) | C (0.85) | B (18,200) | A (100) |
| Example 3 | B (0.94) | B (0.91) | A (No occurrence of development stripe even after passing of 20,000 sheets) | A (100) |
| Example 4 | A (0.98) | B (0.93) | B (19,500) | A (100) |
| Example 5 | A (0.98) | C (0.84) | C (16,000) | A (100) |
| Example 6 | A (0.97) | C (0.83) | C (17,000) | A (100) |
| Example 7 | A (0.98) | B (0.94) | B (19,000) | A (100) |
| Example 8 | A (0.97) | A (0.95) | A (No occurrence of development stripe even after passing of 20,000 sheets) | B (110) |
| Example 9 | A (0.97) | A (0.95) | A (No occurrence of development stripe even after passing of 20,000 sheets) | C (120) |
| Example 10 | A (0.96) | B (0.92) | B (18,700) | A (100) |
| Example 11 | A (0.97) | A (0.95) | A (No occurrence of development stripe even after passing of 20,000 sheets) | B (110) |
| Example 12 | A (0.97) | A (0.95) | A (No occurrence of development stripe even after passing of 20,000 sheets) | B (110) |
| Example 13 | A (0.95) | C (0.89) | C (18,000) | A (100) |
| Example 14 | A (0.96) | B (0.92) | B (19,000) | A (100) |
| Example 15 | A (0.97) | A (0.95) | A (No occurrence of development stripe even after passing of 20,000 sheets) | B (110) |
| Example 16 | A (0.98) | A (0.95) | A (No occurrence of development stripe even after passing of 20,000 sheets) | C (120) |
| Example 17 | A (0.98) | C (0.88) | C (16,000) | A (100) |
| Example 18 | A (0.98) | B (0.94) | B (18,800) | A (100) |
| Example 19 | A (0.98) | C (0.86) | C (16,000) | A (100) |
| Example 20 | B (0.93) | C (0.80) | C (15,100) | C (120) |
| Example 21 | A (0.98) | B (0.93) | B (18,500) | A (100) |
| Example 22 | A (0.98) | A (0.95) | A (No occurrence of development stripe even after passing of 20,000 sheets) | B (110) |
| Example 23 | A (0.98) | A (0.95) | A (No occurrence of development stripe even after passing of 20,000 sheets) | B (110) |
| Example 24 | A (0.98) | C (0.84) | C (16,000) | A (100) |
| Example 25 | A (0.98) | B (0.93) | B (18,500) | A (100) |
| Example 26 | A (0.98) | A (0.96) | A (No occurrence of development stripe even after passing of 20,000 sheets) | B (110) |
| Example 27 | A (0.98) | A (0.96) | A (No occurrence of development stripe even after passing of 20,000 sheets) | C (120) |
| Example 28 | A (0.98) | A (0.97) | A (No occurrence of development stripe even after passing of 20,000 sheets) | B (110) |
| Example 29 | C (0.87) | C (0.84) | C (17,000) | B (110) |
| Comparative Example 1 | D (0.78) | D (0.75) | A (No occurrence of development stripe even after passing of 20,000 sheets) | A (100) |
| Comparative Example 2 | A (0.98) | D (0.79) | D (14,800) | A (100) |
| Comparative Example 3 | A (0.97) | D (0.78) | D (13,500) | A (100) |
| Comparative Example 4 | C (0.89) | D (0.73) | D (8,000) | A (100) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-131015, filed Jun. 30, 2015, which is hereby incorporated by reference herein in its entirety.

What is claimed is:

1. A toner, comprising a toner particle, the toner particle having a core-shell structure comprising:

a core containing a core resin, a colorant, and a wax;

a shell layer containing a resin "A" on a surface of the core, the resin "A" containing a segment having an organopolysiloxane structure and being a polymer of a monomer composition comprising a monomer "a" having two or more polymerizable unsaturated groups in one molecule thereof, the monomer "a" satisfying $(Xa-1.0)\times Ya\geq 3.0\times 10\text{-}5$ where Xa represents an average number of polymerizable unsaturated groups in one molecule of monomer "a", and Ya represents a number of moles (mol/g) of monomer "a" with respect to a total mass of all monomers in the monomer composition; and between the core and the shell layer, an intermediate layer containing a resin "B", the resin "B" containing a segment having an organopolysiloxane structure and being a polymer of a monomer composition containing a monomer "b" having two or more polymerizable unsaturated groups in one molecule thereof, wherein the toner particle has an amount of Si (atomic %) derived from the organopolysiloxane structure of resin "A" of 6.0 to 10.0 measured by X-ray photoelectron spectroscopy (ESCA), resin "A" and resin "B" satisfy Za>Zb, where Za represents an amount of Si of the resin "A" measured by fluorescent X-ray analysis (XRF), and Zb represents an amount of Si of the resin "B" measured by fluorescent X-ray analysis (XRF), and resin "A" and resin "B" further satisfy $(Xa-1.0)\times Ya \geq (Xb-1.0)\times Yb$, where Xb represents an average number of polymerizable unsaturated groups in one molecule of monomer "b" in resin "B", and Yb represents a number of moles (mol/g) of monomer "b" with respect to a total mass of all monomers in the monomer composition in resin "B".

2. A toner according to claim 1, wherein Xa is 2.0 to 4.0.

3. A toner according to claim 1, wherein a content of the resin "A" in the toner particle is 1.0 to 10.0 mass %.

4. A toner according to claim 1, wherein Xb is 2.0 to 4.0.

5. A toner according to claim 1, wherein a content of resin "B" in the toner particle is 1.0 to 10.0 mass %, and resin "A" and resin "B" satisfy $4.0 \leq Ma+Mb \leq 15.0$ where Ma represents a content (mass %) of resin "A" with respect to the toner particle, and Mb represents the content (mass %) of resin "B" with respect to the toner particle.

6. A toner according to claim 1, wherein resin "A" is a polymer of a monomer composition comprising an organopolysiloxane compound having a vinyl group, and the monomer "a" including a polyester having a polymerizable unsaturated group, and resin "A" satisfies $0.5 \leq Ea/Sa \leq 1.8$ where Sa represents a mass of the organopolysiloxane compound having a vinyl group in the monomer composition of resin "A", and Ea represents a mass of the polyester having a polymerizable unsaturated group in the monomer composition of resin "A".

7. A toner according to claim 6, wherein resin "B" is a polymer of a monomer composition comprising an organopolysiloxane compound having a vinyl group, and the monomer "b" including a polyester having a polymerizable unsaturated group, and resin "B" satisfies $1.0 \leq Eb/Sb \leq 2.3$ where Sb represents a mass of the organopolysiloxane compound having a vinyl group in the monomer composition of resin "B", and Eb represents a mass of the polyester having a polymerizable unsaturated group in the monomer composition of resin "B".

8. A toner according to claim 7, wherein Ea/Sa in resin "A" and Eb/Sb in resin "B" satisfy $Ea/Sa < Eb/Sb$.

* * * * *